US010344928B1

(12) United States Patent
Leddusire

(10) Patent No.: US 10,344,928 B1
(45) Date of Patent: Jul. 9, 2019

(54) WALL-PLATE TABLE LAMP

(71) Applicant: DOLAN NORTHWEST, LLC., Portland, OR (US)

(72) Inventor: Ronald R. Leddusire, Seattle, WA (US)

(73) Assignee: DOLAN NORTHWEST, LLC, Portland, OR (US)

( * ) Notice: Subject to any disclaimer, the term of this patent is extended or adjusted under 35 U.S.C. 154(b) by 30 days.

(21) Appl. No.: 15/282,358

(22) Filed: Sep. 30, 2016

(51) Int. Cl.

| | |
|---|---|
| ***F21S 6/00*** | (2006.01) |
| ***F21S 8/00*** | (2006.01) |
| ***F21V 1/00*** | (2006.01) |
| ***F21V 21/02*** | (2006.01) |
| ***F21V 23/00*** | (2015.01) |
| ***F21V 23/04*** | (2006.01) |
| ***F21V 23/06*** | (2006.01) |
| ***F21W 121/00*** | (2006.01) |

(52) U.S. Cl.
CPC ..... *F21S 8/036* (2013.01); *F21S 6/002* (2013.01); *F21V 23/002* (2013.01); *F21V 1/00* (2013.01); *F21V 21/02* (2013.01); *F21V 23/04* (2013.01); *F21V 23/06* (2013.01); *F21W 2121/00* (2013.01)

(58) Field of Classification Search
CPC ..... F21S 8/03–037; F21S 6/00–008; F21V 21/06; F21V 21/10–12
See application file for complete search history.

(56) References Cited

U.S. PATENT DOCUMENTS

| | | | | |
|---|---|---|---|---|
| 2,516,866 | A * | 8/1950 | Halpern | F21S 6/002 362/388 |
| 3,341,702 | A * | 9/1967 | Neumann | F21S 6/003 362/269 |
| 3,601,600 | A * | 8/1971 | Cannon | F21S 6/002 362/269 |
| 4,217,629 | A * | 8/1980 | Russell | F21S 8/037 362/147 |
| 4,713,734 | A | 12/1987 | DeKay | |
| 5,115,385 | A * | 5/1992 | Jeckle | F21S 6/002 362/358 |
| 5,417,573 | A * | 5/1995 | Cassiere, II | F41G 3/2694 434/19 |
| 6,062,704 | A | 5/2000 | Holder | |
| 6,280,065 | B1 * | 8/2001 | Denningham | F21S 6/006 362/410 |
| 6,679,620 | B2 | 1/2004 | Patz et al. | |
| 7,052,157 | B1 | 5/2006 | Lau | |
| 7,347,594 | B2 | 3/2008 | Bayer et al. | |
| 7,699,487 | B2 * | 4/2010 | Schafer | F21S 6/006 362/122 |
| 8,757,815 | B2 | 6/2014 | Saruwatari et al. | |

(Continued)

FOREIGN PATENT DOCUMENTS

| | | | | |
|---|---|---|---|---|
| DE | 3125307 | A1 * | 11/1982 | F21S 6/002 |
| WO | WO 9106200 | A1 * | 5/1991 | F21S 6/002 |

*Primary Examiner* — Mariceli Santiago
(74) *Attorney, Agent, or Firm* — Schwabe Williamson & Wyatt

(57) ABSTRACT

A table lamp comprising a table-lamp base configured to rest on a horizontal surface, a wall plate assembly configured to abut a vertical surface above the horizontal surface, and an electrical cable coupling the table-lamp base to the wall plate assembly. The electrical cable is configured to transmit electrical power from the table-lamp base to the wall plate assembly. The wall plate assembly has a light source.

40 Claims, 38 Drawing Sheets

(56) References Cited

U.S. PATENT DOCUMENTS

| | | | | |
|---|---|---|---|---|
| 9,322,533 | B1 | 4/2016 | Pearson et al. | |
| 2008/0258642 | A1* | 10/2008 | Patel | F21S 6/002 315/246 |
| 2014/0168985 | A1* | 6/2014 | Chien | F21S 8/035 362/253 |
| 2017/0328127 | A1* | 11/2017 | Stathis | A47B 21/06 |

* cited by examiner

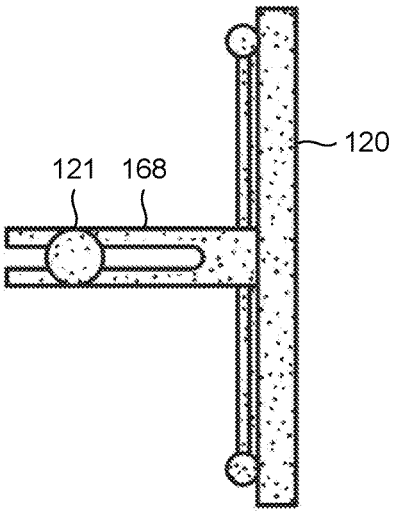
FIG. 35A
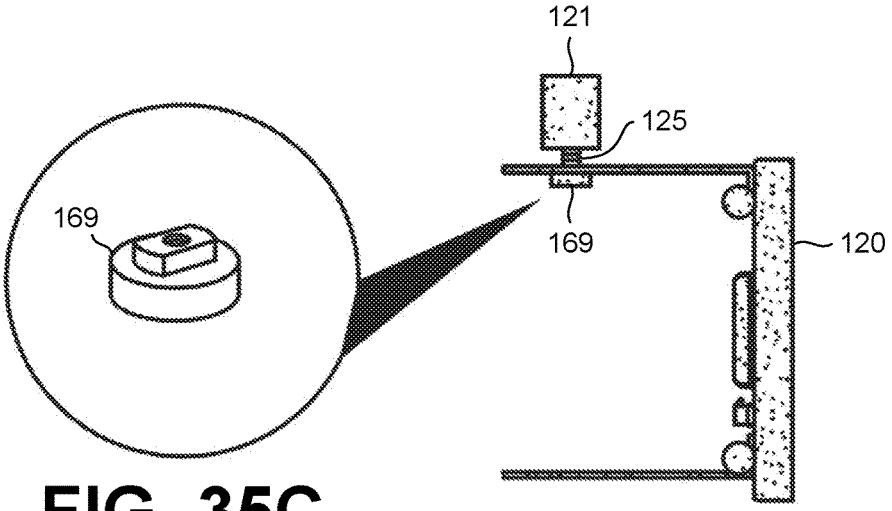
FIG. 35C
FIG. 35B

WALL-PLATE TABLE LAMP

FIELD OF THE INVENTION

This disclosure is directed to a lamp having features of a wall lamp and a table lamp.

BACKGROUND

Conventional table lamps generally take up a large footprint on a table and are not secured to the table or the wall. As such, the lamps may fall or be knocked from the table, and table lamps are occasionally stolen from hotels. While some table-mounted, bolt-down lamps exist, their large footprint takes up a substantial amount of space on the table.

Additionally, conventional sconces and wall lamps generally have an on/off switch at the wall fixture for the wall lamp or otherwise at a wall switch elsewhere in the room where the conventional wall lamp is installed. But such switches are often placed in an inconvenient location for an operator of the lamp. This is especially so, for example, if the conventional wall lamp is mounted at the operator's bedside and the operator is attempting to operate the switch while lying down.

Furthermore, the design elements of conventional lamps may not be changed or, if the design elements can be changed, doing so requires rewiring the lamp. With lighting technology evolving to provide longer life light sources, such as LED, the conventional table lamp may outlive the design preferences of the lamp's owner. For example, a hotel's design changes about every seven years, and existing LED light sources may last twenty-one years or longer under estimated hotel guestroom use. Thus, an LED light source may have an operating lifetime more than three times longer than the aesthetic lifetime of the conventional lamp in which the LED light source is installed.

Embodiments of the invention address these and other shortcomings in the prior art.

SUMMARY OF THE DISCLOSURE

Embodiments of the disclosed subject matter are directed to a lamp having features of a wall lamp and a table lamp. Furthermore, the disclosed wall-plate table lamp may provide a space saving, versatile, and sustainable lamp with changeable decorative elements.

Accordingly, at least some embodiments of a table lamp may include a table-lamp base configured to rest on a horizontal surface, a wall plate assembly configured to abut a vertical surface above the horizontal surface, and an electrical cable coupling the table-lamp base to the wall plate assembly. The electrical cable is configured to transmit electrical power from the table-lamp base to the wall plate assembly. The wall plate assembly has a light source.

In another aspect, in at least some embodiments of a table lamp, the wall plate assembly is further configured to be affixed to the vertical surface.

In yet another aspect, in at least some embodiments of a table lamp, a replaceable decorative element extends between the table-lamp base and the wall plate assembly, and the table lamp is configured to permit replacement of the decorative element without disconnecting the electrical cable coupling the table-lamp base to the wall plate assembly.

In still another aspect, in at least some embodiments of a table lamp, the table-lamp base is configured to adjust toward or away from the vertical surface while the wall plate assembly abuts the vertical surface.

In yet another aspect, at least some embodiments of a self-standing table lamp may include a table-lamp base configured to rest on a horizontal surface, a wall plate assembly, and an electrical cable coupling the table-lamp base to the wall plate assembly. The wall plate assembly includes a substantially vertical plate having a front face with a light source. The electrical cable is configured to transmit electrical power from the table-lamp base to the wall plate assembly.

These and other features, aspects, and advantages of the disclosed subject matter will become better understood with reference to the following description, the appended claims, and the accompanying drawings of embodiments of the invention.

BRIEF DESCRIPTION OF THE DRAWINGS

FIG. 35A is a top view of a wall plate assembly, showing a finial adjustment bracket with an elongated slot and a machined nut configured to engage the elongated slot. FIG. 35B is a right side view of the wall plate assembly of FIG. 35A. FIG. 35C is a detailed perspective view of the machined nut of FIGS. 35A and 35B.

DETAILED DESCRIPTION

As described herein, embodiments of the invention are directed to a lamp having features of a wall lamp and a table lamp. Furthermore, the disclosed wall-plate table lamp may provide a space saving, versatile, and sustainable lamp with changeable decorative elements.

The lamp includes a table-lamp base and a wall plate with a light source affixed to the wall plate. When the table-lamp base is positioned at the back of a table adjacent to a wall, the wall plate will then be flush with, rest against, or be affixed to the wall. Accordingly, more usable space is created on the table's surface. The term "table" as used in this disclosure means a table or another horizontal surface. Also, the term "wall" as used in this disclosure means a wall or another vertical surface.

In addition, having the wall plate be against or affixed to the wall provides additional stability and security for the lamp. Such a feature may be preferred in, for example, hotels, senior housing, healthcare, and children's rooms. Light emitted from the light source may be diffused with a diffuser, or lampshade. Also, the light source may be switched at the table-lamp base, which may be more convenient than a wall switch, especially for a bedside lamp. The wall-plate table lamp may have adjustments to adapt to variances among different walls and tables. The wall-plate table lamp may also be configured to receive and remove decorative elements without rewiring the lamp. The versatility of the decorative elements allows an operator to change the decoration without replacing, and perhaps discarding, the entire lamp. Given that existing LED light sources may last twenty-one years or longer under estimated hotel guestroom use, the decorative elements could be changed three or more times while keeping the remainder of the lamp. This saves money and resources and makes the lamp more sustainable.

Figure 3:
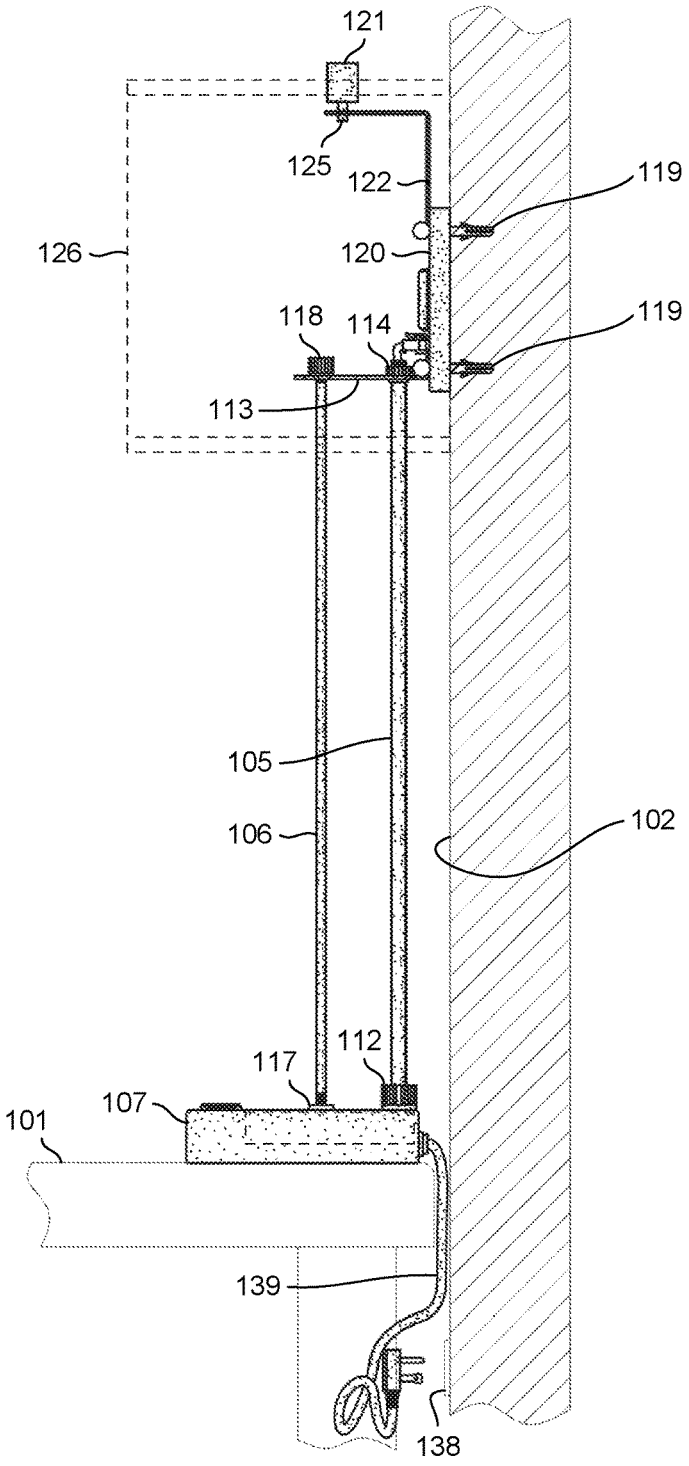
FIG. 3 is a side view of the wall-plate table lamp of FIG. 1, also shown on a table and abutting a wall.
Figures 4A, 4B:
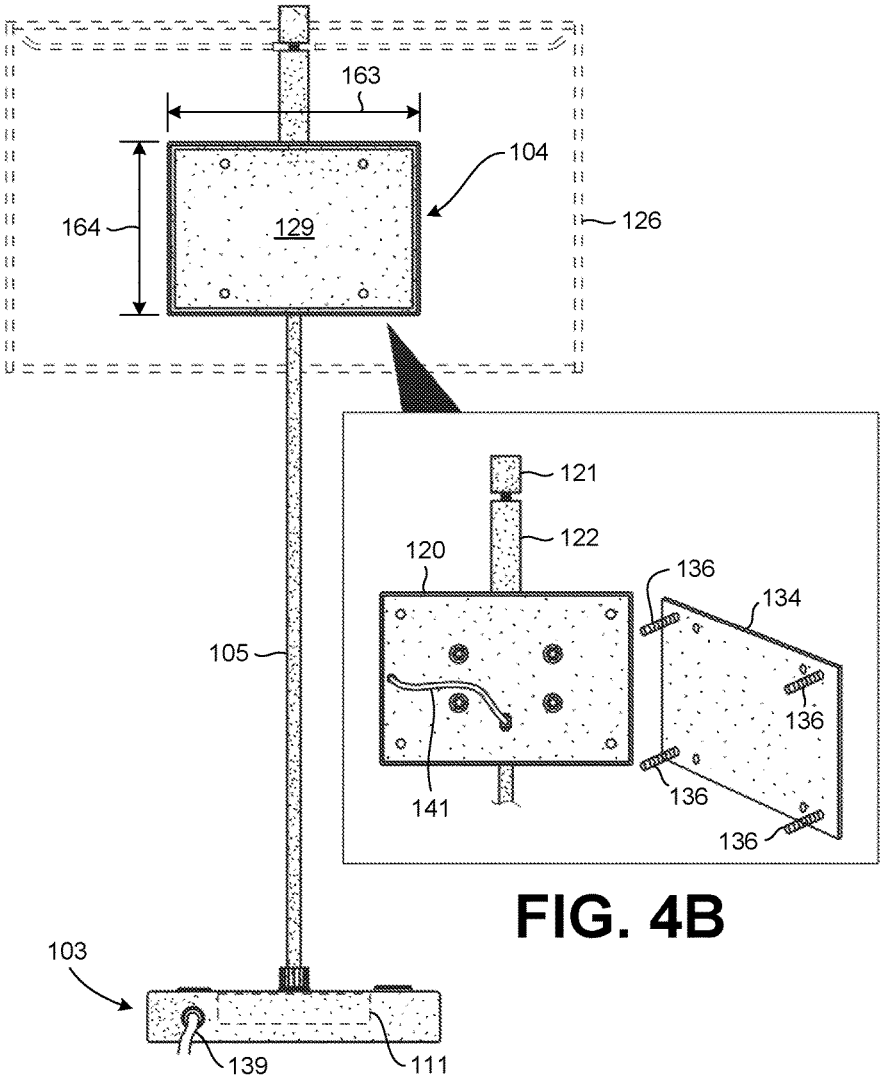
FIG. 4A is a rear view of the wall-plate table lamp of FIG. 1.
FIG. 4B is an inset detail view of a mounting plate that may be included with the wall-plate table lamp of FIG. 1.

FIGS. 1-3, 4A, and 5 are, respectively, a perspective view, a front view, a side view, a rear view, and a top view showing material portions of a wall-plate table lamp 100 according to embodiments of the invention. As shown in FIG. 3, the wall-plate table lamp 100 may be placed on a table 101 and abut a wall 102. The term "abut" as used in this disclosure means to contact. FIG. 4B is an inset detail view of a wall mounting plate 134 that may be included with the wall-plate table lamp 100. As illustrated in FIGS. 1-5, the wall-plate table lamp 100 may include a base assembly 103 and a wall plate assembly 104 coupled by a stem 105 and a rod 106.

The base assembly 103 may provide lateral stability to the wall-plate table lamp 100 and receive electrical power. The base assembly 103 may further be configured to manipulate the electrical power before the power passes to the wall plate assembly 104, as further described below. The base assembly 103 may include a table-lamp base 107, a universal serial bus (USB) port 108, an electrical switch 109, an electrical outlet port 110, and a weight 111.

The weight 111 may be provided inside of the table-lamp base 107 to allow the wall-plate table lamp 100 to be self-standing by causing the center of mass of the wall-plate table lamp 100 to be within the table-lamp base. The USB port 108 may provide electrical power to a separate device when the separate device, such as a mobile device, is connected to the USB port 108. Likewise, the electrical outlet port 110 may provide electrical power to a separate device when the separate device, such as a laptop computer, is connected to the electrical outlet port 110. The electrical switch 109 may be, for example, an on-off toggle switch, a dimmer switch, a selector switch, a color adjustment switch, or any other switch configured to provide or meter electrical power to one or more of the wall-plate assembly 104, the USB port 108, or the electrical outlet port 110.

The table-lamp base 107 has a table contact area, defined as the area of the underside 144 of the table-lamp base 107, which the wall-plate table lamp 100 rests upon during typical use. For example, for a rectangular table-lamp base 107, such as the table-lamp base 107 illustrated in FIG. 15, the table contact area is the length 160 of the table-lamp base 107 multiplied by the width 161 of the table-lamp base 107. As another example, for the rounded table-lamp base 150 illustrated in FIG. 17, the table contact area is the area of the partial circle shown in FIG. 17.

The stem 105, or wire cover, provides a channel for electrical wires to travel between the base assembly 103 and the wall plate assembly 104. This is also described below in relation to FIG. 12. As illustrated in FIGS. 1-5, the stem 105 may be affixed to the table-lamp base 107 with a stem lock-down nut 112 and then affixed to a rod-and-stem bracket 113 with a stem nut 114. Preferably, the rod-and-stem bracket 113 includes a slot 115, such as shown in FIGS. 7 and 11. The slot 115 in the rod-and-stem bracket 113 is configured to allow the rod 106, the stem 105, or both to move toward or away from the wall plate 120 within the slot 115. The rod-and-stem bracket 113 is affixed to the wall plate 120 as further described below for FIGS. 6A-11. Thus, in addition to providing a conduit for electrical wires, the stem 105 may be structural and configured to hold the wall plate assembly 104 in a desired position or positions relative to the base assembly 103 as well as relative to the wall 102 or table 101. Each stem 105 may have a round, square, or rectangular cross-section, although other shapes are also contemplated.

The rod 106 is configured to accept a decorative element, such as described below for FIGS. 13A and 13B. The rod 106 may be affixed to the table-lamp base 107 with a threaded coupling 117 and then held to the rod-and-stem bracket 113 with a rod nut 118. Thus, like the stem 105, the rod 106 is configured to provide structural support between the wall plate assembly 104 and the base assembly 103.

The stem 105 and the rod 106 may be made from, for example, metal, plastic, or wood, although other material could also be used.

The wall plate assembly 104 has a wall contact area, defined as the area of the backside 129 of the wall plate assembly 104, which may contact the wall 102 during typical use. For example, for a rectangular wall plate assembly 104, such as the wall plate assembly 104 illustrated in FIG. 4A, the wall 102 contact area is the length 163 of the wall plate assembly 104 multiplied by the width 164 of the wall plate assembly 104.

Preferably, the wall contact area is at least thirty percent of the table contact area of the table-lamp base 107. More preferably, the wall contact area is at least fifty percent of the table contact area. Even more preferably, the wall contact area is at least seventy percent of the table contact area.

As illustrated in FIG. 3, the wall-plate table lamp 100 may be affixed to the wall 102 with a wall anchor 119. Alternatively, the wall-plate table lamp 100 may be securely affixed to the wall 102 by screws, glue, tape, or another affixing method. The wall plate assembly 104 provides stability to the wall-plate table lamp 100 by abutting the wall 102, even if the wall plate assembly 104 is not affixed to the wall 102.

Figure 5:
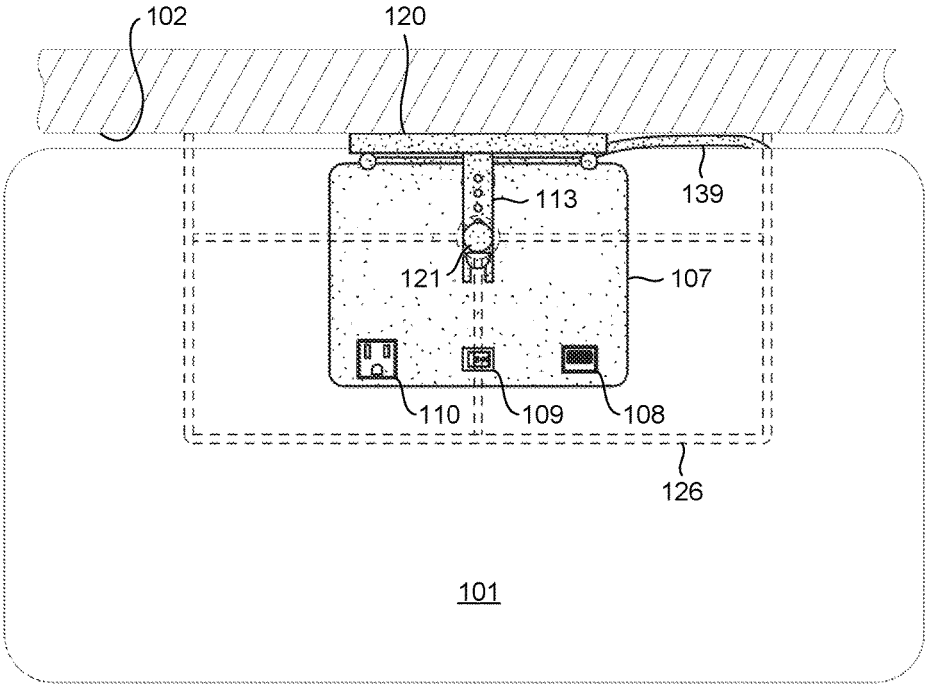
FIG. 5 is a top view of the wall-plate table lamp of FIG. 1, also shown on a table and abutting a wall.

FIG. 3 also illustrates the wall-plate table lamp 100 resting on a table 101. As shown in FIGS. 3 and 5, the wall-plate table lamp 100 has a minimal footprint on the table 101 because the wall-plate table lamp 100 is pushed back towards the wall 102, with the table-lamp base 107 at the back edge of the table 101. Hence, the wall-plate table lamp 100 is closer to the wall 102 than a conventional table lamp would be. That is, a conventional table lamp typically is not placed against an edge of the table to prevent the lamp from toppling off of the table. Thus, a table having the wall-plate table lamp 100 has more usable space on its top surface than a table with a conventional table lamp. Moreover, since different tables have different distances or gaps from the wall 102, the rod-and-stem bracket 113 allows adjustability toward and away from the wall 102, and also toward or away from the edge of the table 101, permitting the wall-plate table lamp 100 to conform to a range of table 101 dimensions.

Figure 1:
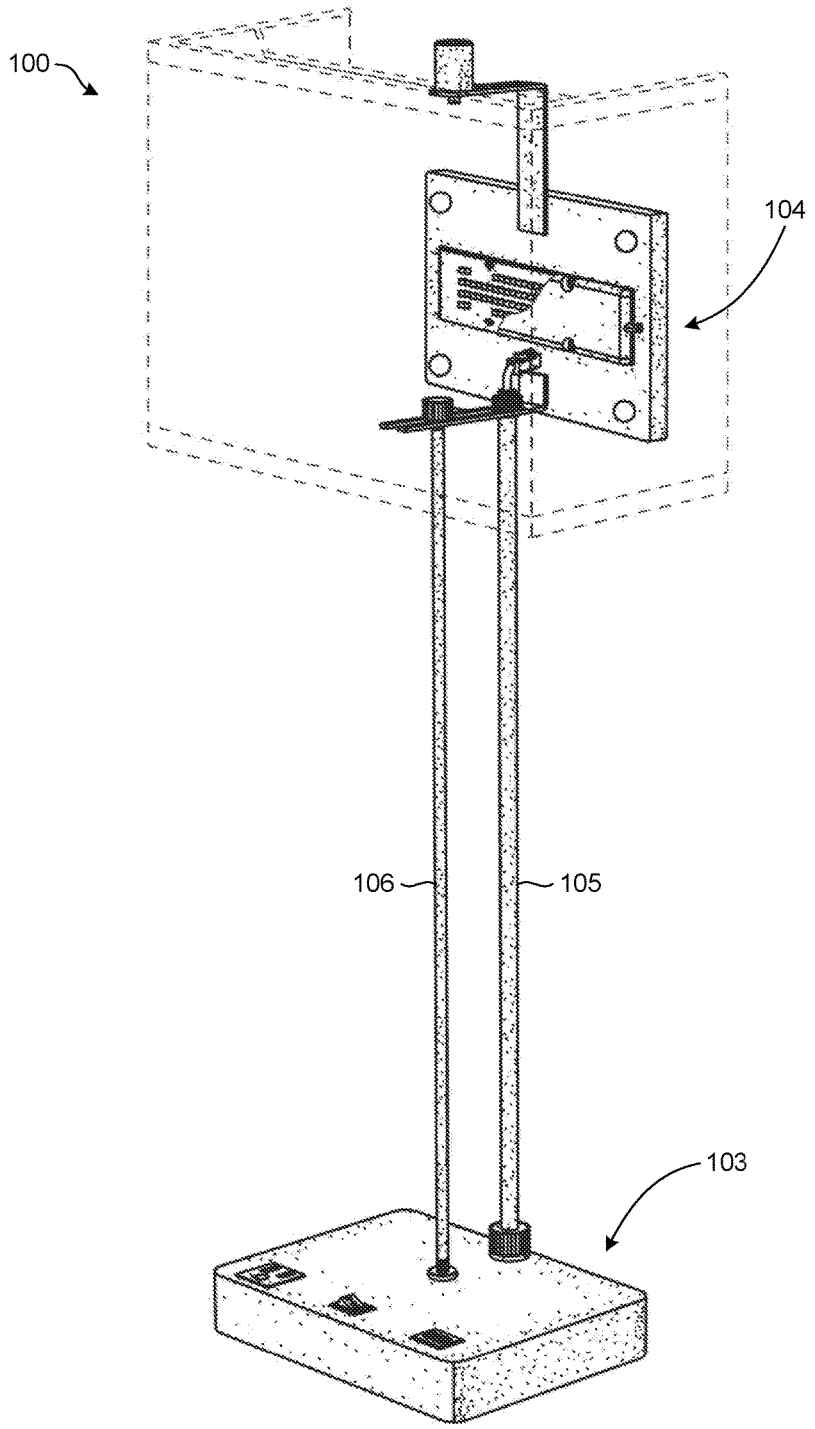
FIG. 1 is a perspective view of a wall-plate table lamp, according to embodiments of the invention.
Figure 2:
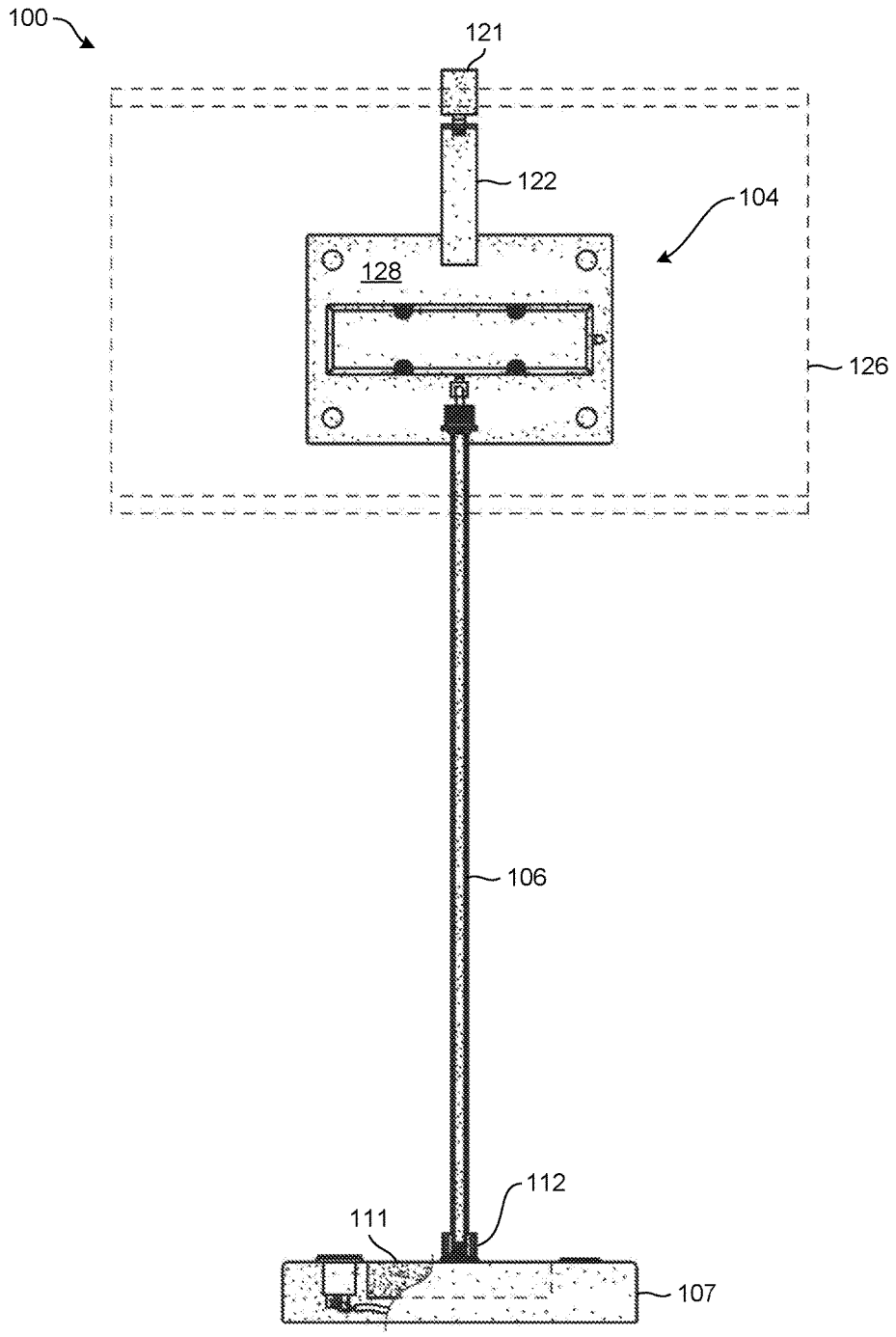
FIG. 2 is a front view of the wall-plate table lamp of FIG. 1.
Figure 6A:
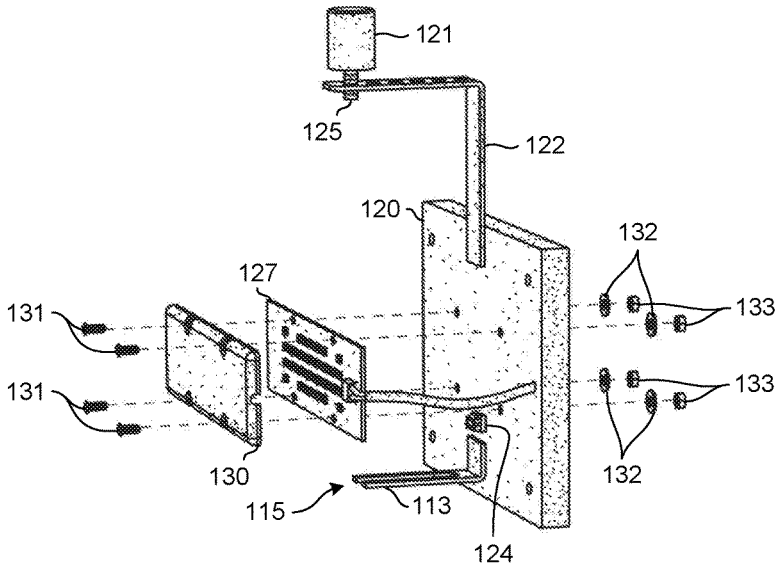
FIG. 6A is a perspective exploded view of a wall plate of the wall-plate table lamp of FIG. 1, showing a method of assembly of a front portion of the wall plate.
Figure 6B:
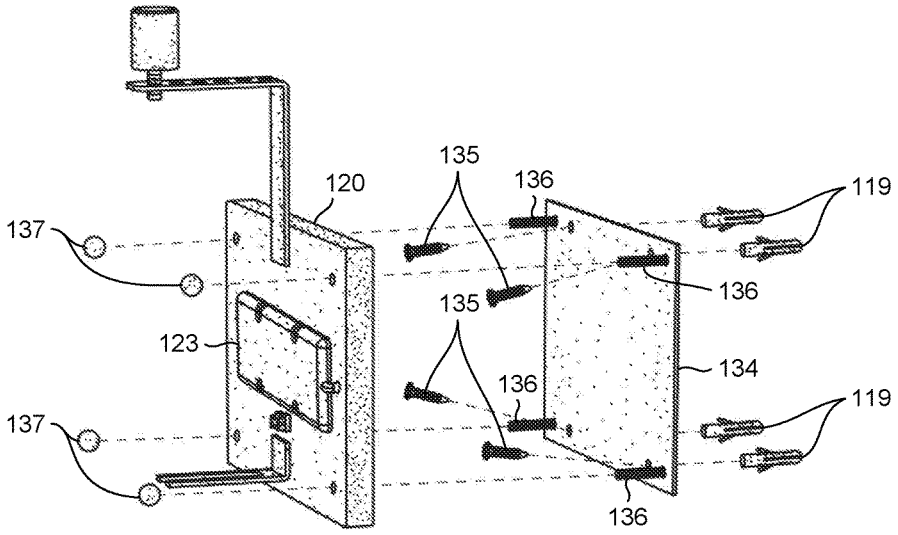
FIG. 6B is a perspective exploded view of the wall plate of FIG. 1, showing a method of assembly of a rear portion of the wall plate.
Figure 7:
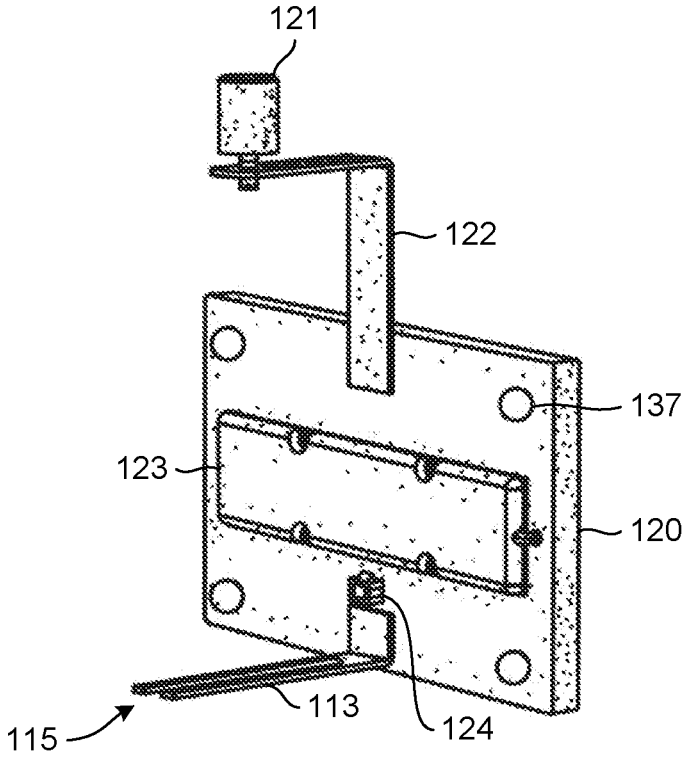
FIG. 7 is a perspective view of the wall plate of FIGS. 6A and 6B.
Figure 8:
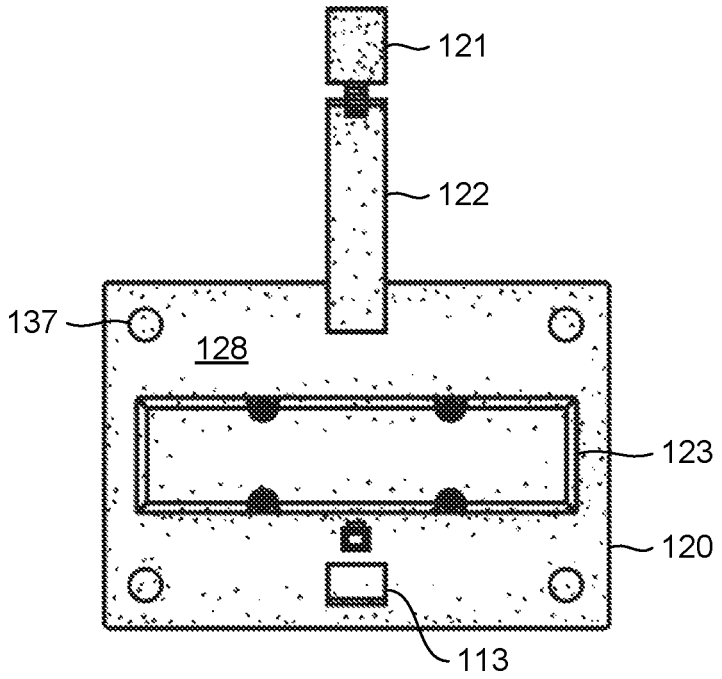
FIG. 8 is a front view of the wall plate of FIGS. 6A and 6B.
Figure 9:
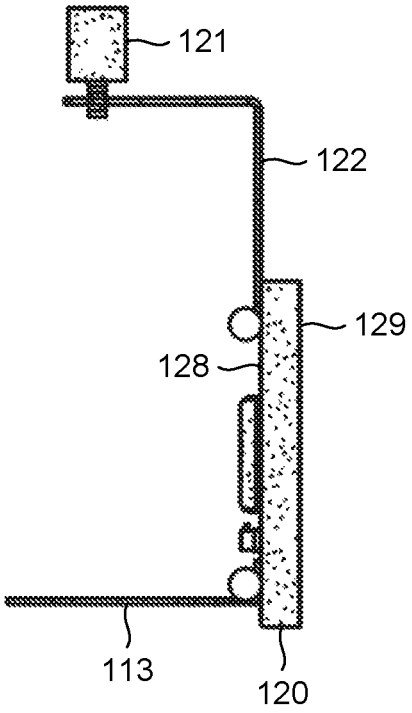
FIG. 9 is a side view of the wall plate of FIGS. 6A and 6B.

FIG. 6A is a perspective exploded view showing material portions of a wall plate 120 of the wall-plate table lamp 100 of FIG. 1, and also showing a method of assembly of a front portion of the wall plate 120. FIG. 6B is a perspective exploded view showing material portions of the wall plate 120 of the wall-plate table lamp 100 of FIG. 1, and also showing a method of assembly of a rear portion of the wall plate 120. FIGS. 7-11 are, respectively, a perspective view, a front view, a side view, a top view, and a bottom view of the wall plate 120 of FIGS. 6A and 6B.

Figure 10:
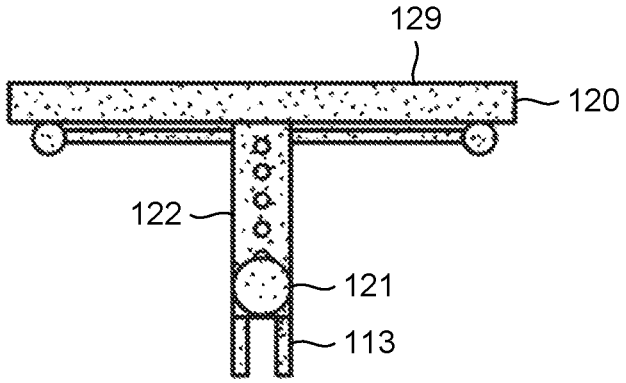
FIG. 10 is a top view of the wall plate of FIGS. 6A and 6B.
Figure 11:
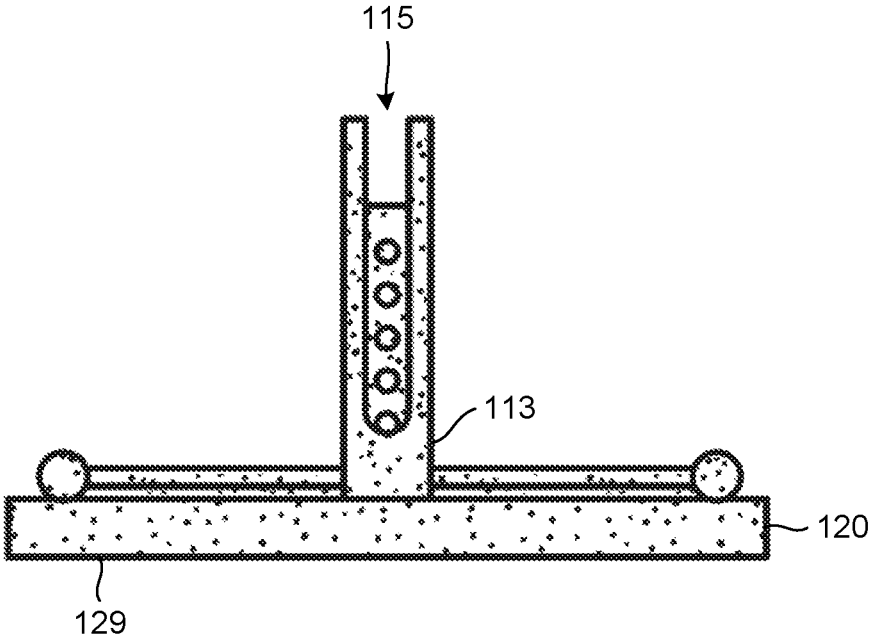
FIG. 11 is a bottom view of the wall plate of FIGS. 6A and 6B.

As illustrated in FIGS. 6A-11, the wall plate assembly 104 may include a wall plate 120, a finial 121, a finial adjustment bracket 122, a light source 123, the rod-and-stem bracket 113, and a light source wire connector 124. The finial adjustment bracket 122 is affixed to the wall plate 120, and the finial 121 may be coupled to the finial adjustment bracket 122 by a threaded post 125. The finial adjustment bracket 122 may support a diffuser 126, or lampshade, configured to diffuse light emitted from the light source 123 The diffuser 126 may be clamped between the finial adjustment bracket 122 and the finial 121 by threading the finial 121 with the threaded post 125 onto the finial adjustment bracket 122. As shown in FIG. 10, the finial adjustment bracket 122 may include a series of holes that the finial 121 with the threaded post 125 may be threaded into. Thus, the finial 121 may be moved toward or away from the wall 102 by installing the finial 121 with the threaded post 125 in a hole that is closer or farther away from the wall 102. The light source wire connector 124 is mounted to the wall plate 120 and provides an electrical connection as described below for FIG. 12.

As illustrated in FIG. 6A, the light source 123 may be on the front side 128 of the wall plate 120 and may include a light-emitting diode (LED) panel 127. Instead of, or in addition to, an LED panel 127, the light source 123 may include one or more compact fluorescent bulbs 156 (see FIGS. 26A-26B) or incandescent bulbs. Also, the LED panel 127 may include organic LED (OLED). The light source 123 may be protected by a light source cover 130. The LED panel 127 and the light source cover 130 may be affixed to the wall plate 120 by light source mounting bolts 131 mating with light source mounting washers 132 and light source mounting nuts 133 on the backside 129 of the wall plate assembly 104.

As illustrated in FIG. 6B, a wall mounting plate 134 may be affixed to the wall 102 with the wall anchors 119 and anchor screws 135 or, alternatively, with glue, tape, or another affixing method. The wall mounting plate 134 may attach to the wall plate 120 with wall plate mounting bolts 136 and mounting ball nuts 137.

Figure 12:
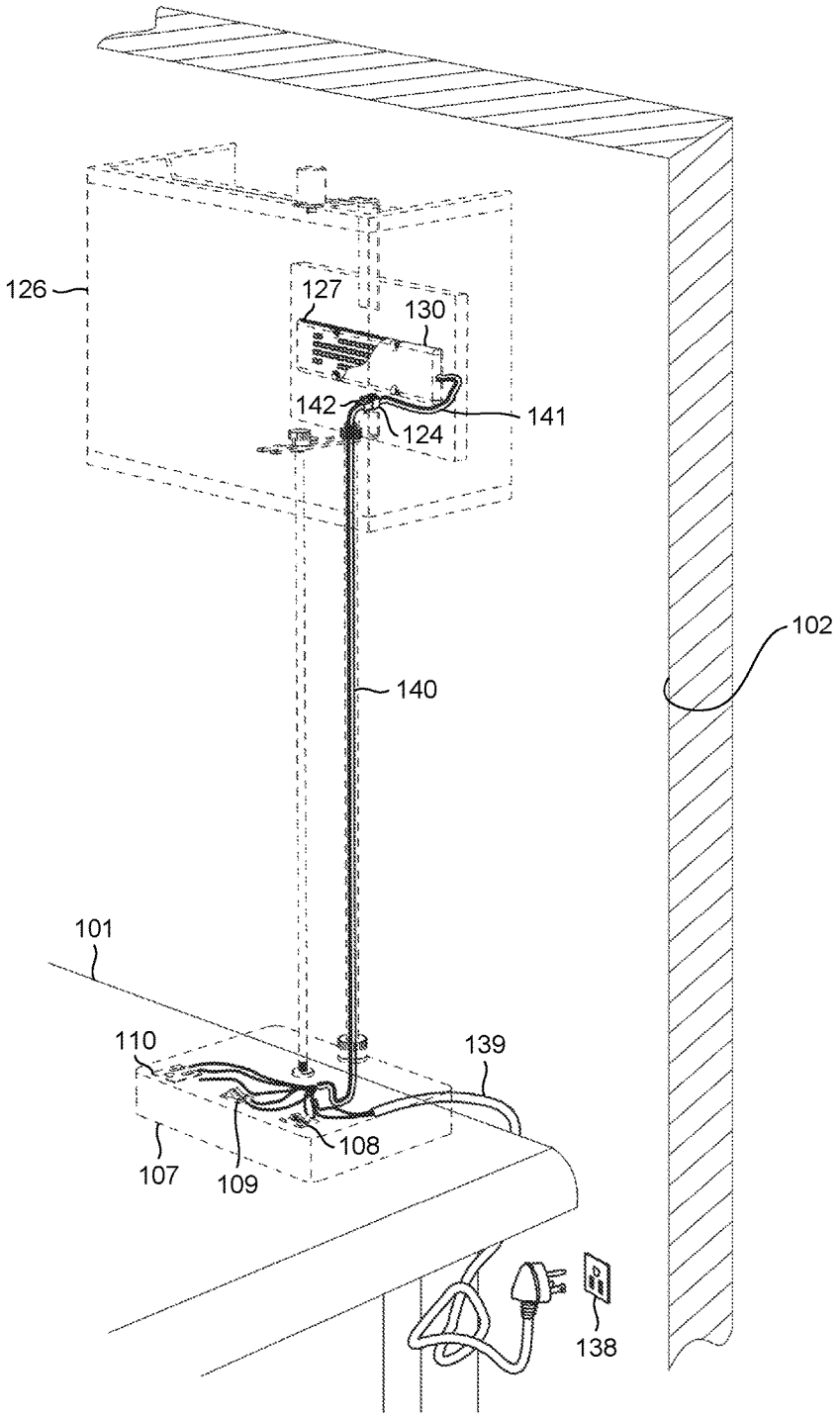
FIG. 12 is a perspective view of the wall-plate table lamp of FIG. 1 and shown on a table and abutting a wall, with portions of the wall-plate table lamp shown in phantom lines to illustrate a version of the electrical wiring.

FIG. 12 is a perspective view of the wall-plate table lamp 100 of FIG. 1 and shown on a table 101 and abutting a wall 102, with portions of the wall-plate table lamp 100 shown in phantom lines to illustrate a version of the electrical wiring. As illustrated in FIG. 12, the power supply starts with a power outlet 138 that a power cord 139 plugs into. The power cord 139 brings the electrical power into the table-lamp base 107, where the electrical power may be routed to provide power to the electrical outlet port 110, the USB port 108, and the electrical switch 109. The electrical power also travels through a power supply wire 140, or electrical cable, to a light source power wire 141. Preferably, the stem 105 substantially encloses the power supply wire 140 between the table-lamp base 107 and the rod-and-stem bracket 113. Preferably, the power supply wire 140 is coupled to the light source power wire 141 through the light source wire connector 124 that is mounted to the wall plate 120. Accordingly, the power supply wire 140 may have a wire connector 142 at an end of the power supply wire 140 that is configured to mate with the light source wire connector 124. Alternatively, the power supply wire 140 and the light source power wire 141 may be a continuous wire. When the wire connector 142 is plugged into the light source wire connector 124, the electrical power passes through the light source power wire 141 to the light source 123. The wire connector 142 and the light source wire connector 124 allow quick assembly and easy connection of the electrical power to the light source 123. Thus, if the light source 123 needed to be replaced, it could be easily disconnected and a new light source 123 could be easily reconnected.

Figure 13A:
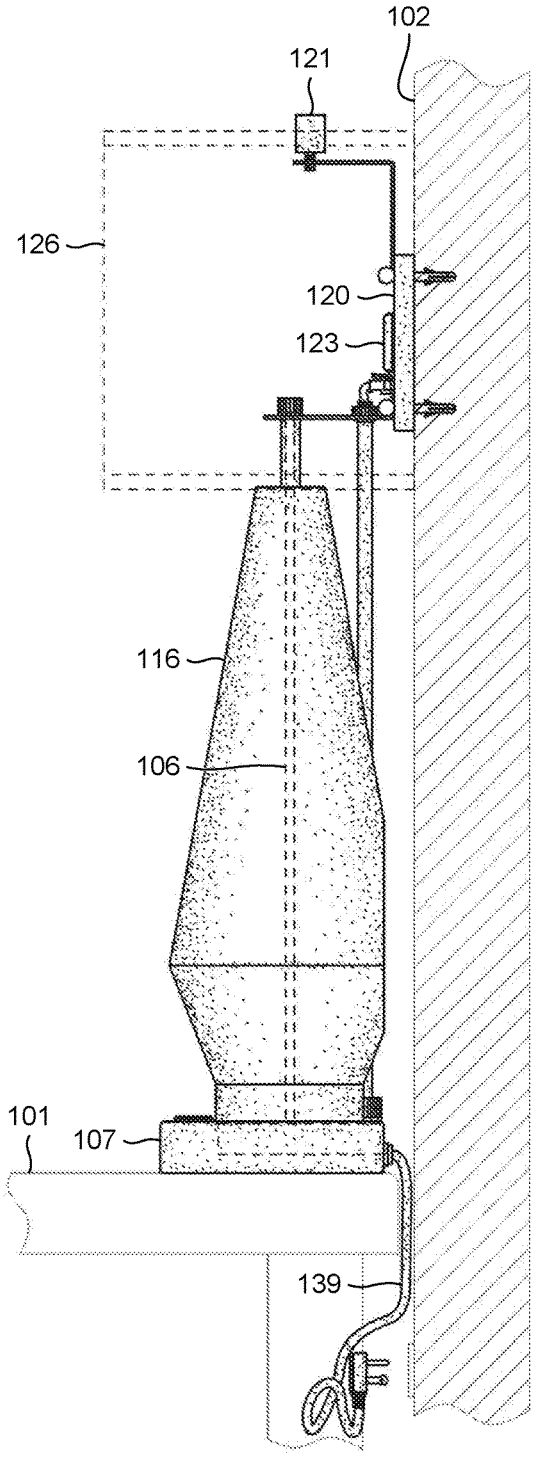
FIG. 13A is a side view of the wall-plate table lamp of FIG. 1 shown on a table and abutting a wall and including a top-affixed decorative element.
Figure 13B:
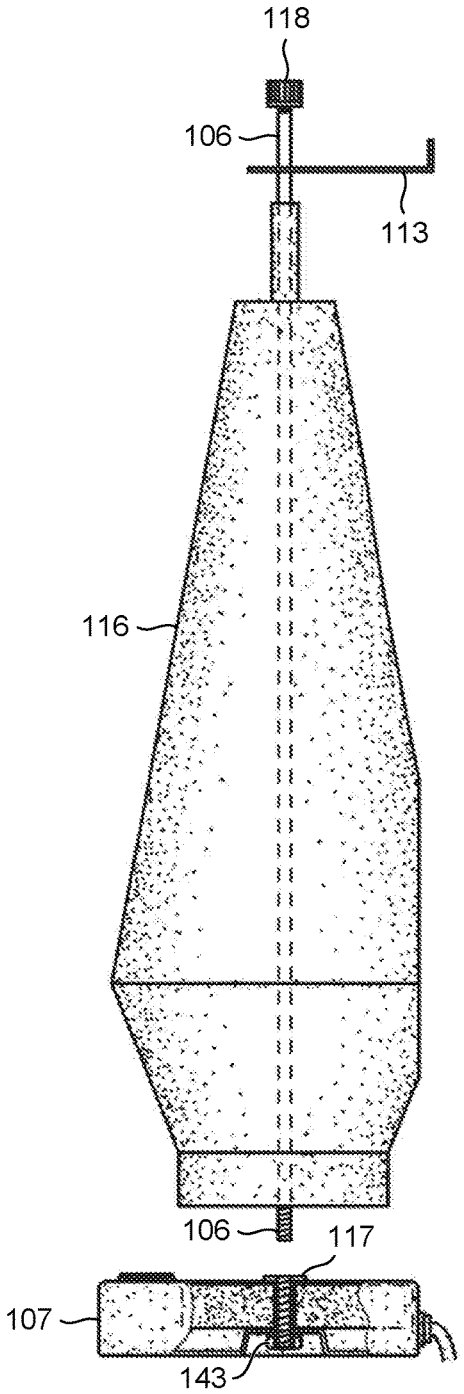
FIG. 13B is a detailed illustration of a top affixing method for a decorative element.

FIG. 13A is a side view of the wall-plate table lamp 100 of FIG. 1 shown on a table 101 and abutting a wall 102 and including a top-affixed decorative element 116. FIG. 13B is a detailed illustration of a top affixing method for a decorative element. As illustrated in FIGS. 13A-13B, the rod 106 runs through the top-affixed decorative element 116. Rotating the rod nut 118 threads the rod 106 into the threaded coupling 117 and tightens the rod nut 118 to the rod-and-stem bracket 113, securing the top-affixed decorative element 116 to the table-lamp base 107. The threaded coupling 117 may be affixed to the table-lamp base 107 with a coupling nut 143 on the underside 144 of the table-lamp base 107. Because the power supply wire 140 passes to the wall plate assembly 104 separately from the top-affixed decorative element 116, the top-affixed decorative element 116 may be removed and replaced with another top-affixed decorative element 116 or with a bottom-affixed decorative element 145 (see FIGS. 14A-14B) without needing to rewire the wall-plate table lamp 100. The top-affixed decorative element 116 may also add rigidity to the wall-plate table lamp 100 by providing additional structure between the base assembly 103 and the wall plate assembly 104. Accordingly, the top-affixed decorative element 116 may be easily removed or replaced in accordance with evolving design trends over the life of the wall-plate table lamp 100.

Figure 14B:
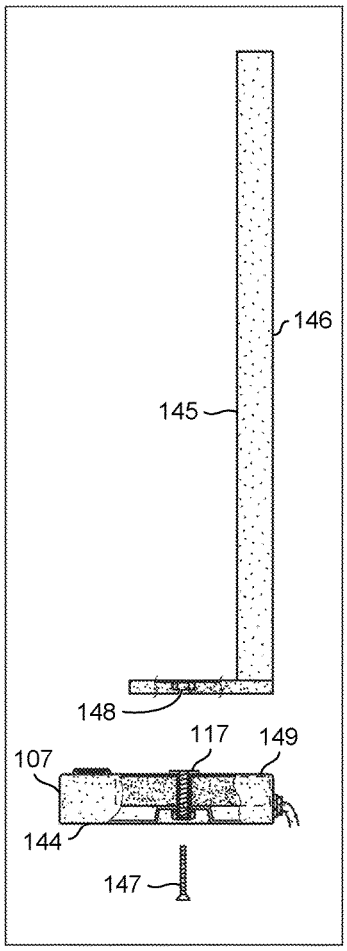
FIG. 14B is a detailed illustration of a bottom affixing method for a decorative element.
Figure 14A:
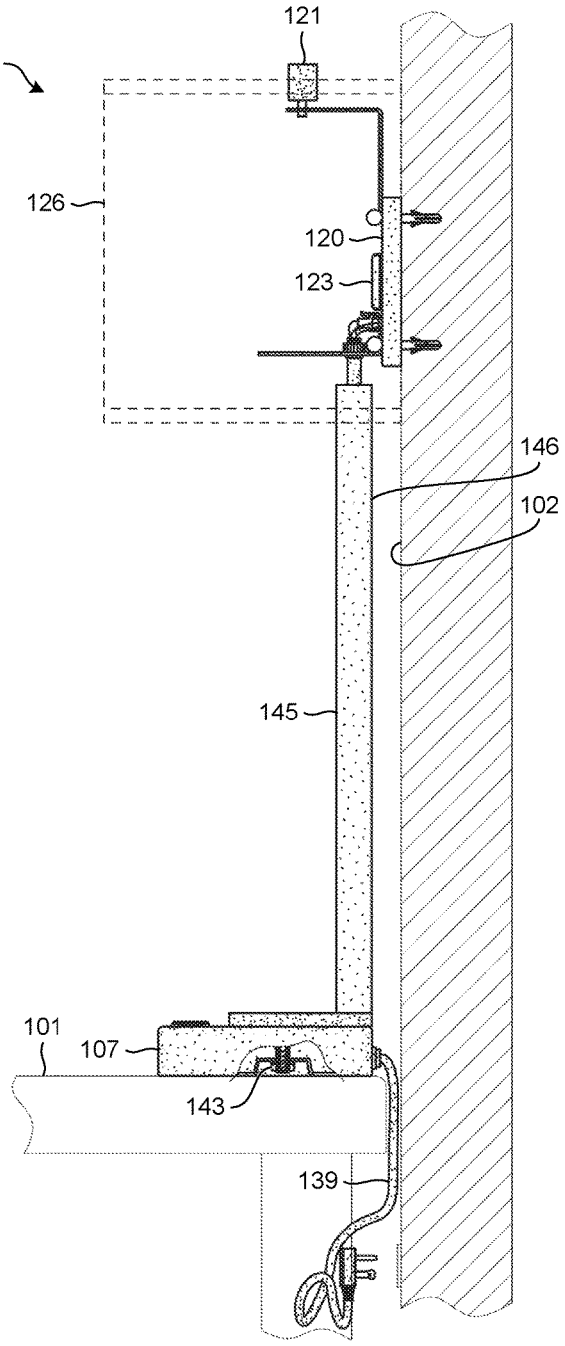
FIG. 14A is a side view of a wall-plate table lamp, according to embodiments of the invention, shown on a table and abutting a wall and including a bottom-affixed decorative element 145.
Figure 15:
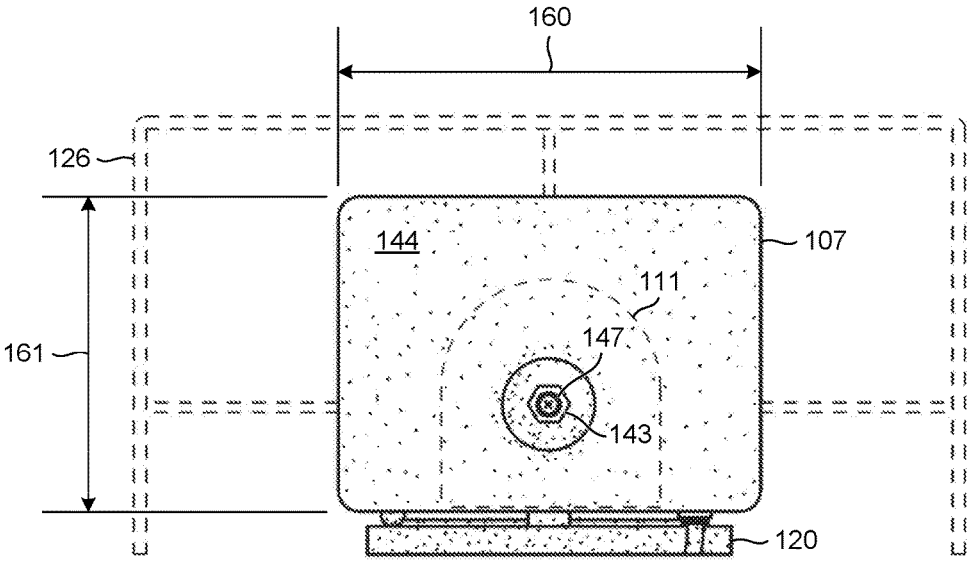
FIG. 15 is a bottom view of the wall-plate table lamp of FIG. 1.

FIG. 14A is a side view of a wall-plate table lamp 200, according to embodiments of the invention shown on a table 101 and abutting a wall 102 and including a bottom-affixed decorative element 145. FIG. 14B is a detailed illustration of a bottom affixing method for a decorative element. FIG. 15 is a bottom view of the wall-plate table lamp 200 of FIG. 14A. As illustrated in FIGS. 14A-15, the wall-plate table lamp 200 is generally as described above for the wall-plate table lamp 100 of FIGS. 1-12, but the wall-plate table lamp 200 may lack the rod 106 of the wall-plate table lamp 100. Instead, the wall-plate table lamp 200 includes the bottom-affixed decorative element 145.

The bottom-affixed decorative element 145 may at least partially surround the stem 105. For example, a backside 146 of the bottom-affixed decorative element 145 may be open or partially open, allowing the bottom-affixed decorative element 145 to partially surround the stem 105.

As shown in FIGS. 14A and 14B, a bottom attachment screw 147 passes through the threaded coupling 117 and attaches to a bottom attachment nut 148 affixed to the bottom-affixed decorative element 145. When the bottom attachment screw 147 is tightened, the bottom-affixed decorative element 145 is tight against the top surface 149 of the table-lamp base 107. Hence, the bottom-affixed decorative element 145 may be removed and replaced with another bottom-affixed decorative element 145 or with a top-affixed decorative element 116 without needing to rewire the wall-plate table lamp 200. Accordingly, the bottom-affixed decorative element 145 may be easily removed or replaced in accordance with evolving design trends over the life of the wall-plate table lamp 200.

Figure 16:
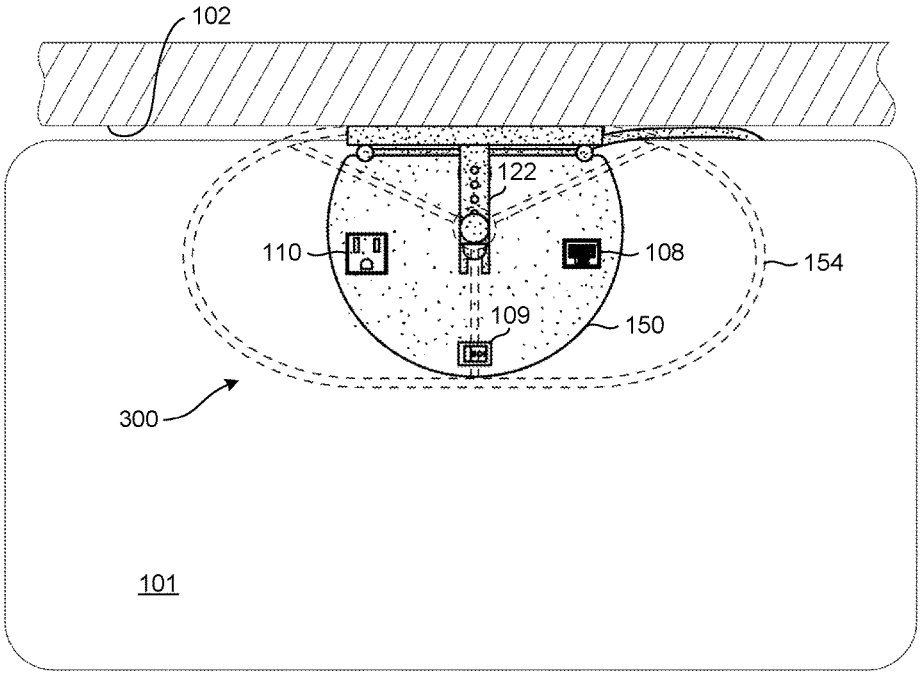
FIG. 16 is a top view of a wall-plate table lamp on a table and abutting a wall and having a rounded base, according to embodiments of the invention.
Figure 17:
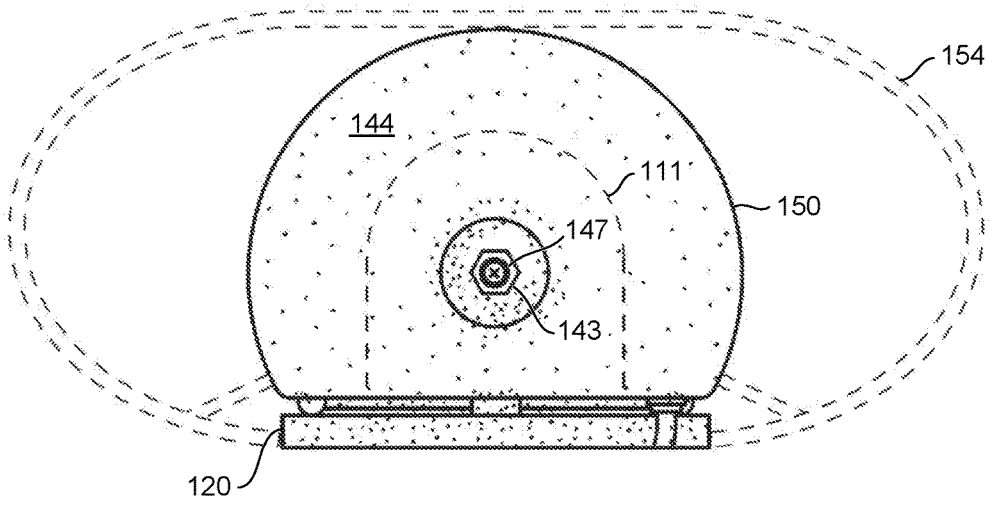
FIG. 17 is a bottom view of the wall-plate table lamp of FIG. 16, but without the table or the wall.

FIG. 16 is a top view of a wall-plate table lamp 300 on a table 101 and abutting a wall 102 and having a rounded table-lamp base 150, according to embodiments of the invention. FIG. 17 is a bottom view of the wall-plate table lamp 300 of FIG. 16, but without the table 101 or the wall 102. As illustrated in FIGS. 16-17, the wall-plate table lamp 300 is generally as described above for the wall-plate table lamp 100 of FIGS. 1-12 or the wall-plate table lamp 200 of FIGS. 14A-15, but the wall-plate table lamp 300 has a rounded table-lamp base 150. The rounded table-lamp base 150 may be used with a bottom-affixed decorative element 145, a top-affixed decorative element 116, and other configurations.

FIGS. 18-25 illustrate several versions of the diffuser 126. While depicted in the figures with particular configurations, each diffuser 126 may be used with other configurations, too, including the wall-plate table lamp 100 of FIGS. 1-12, the wall-plate table lamp 200 of FIGS. 14A-15, and the wall-plate table lamp 300 of FIGS. 16-17. Moreover, the diffuser 126 may be made from a variety of materials, including plastic, acrylic, glass, and wood, depending on the desired diffusion effect.

Figure 19:
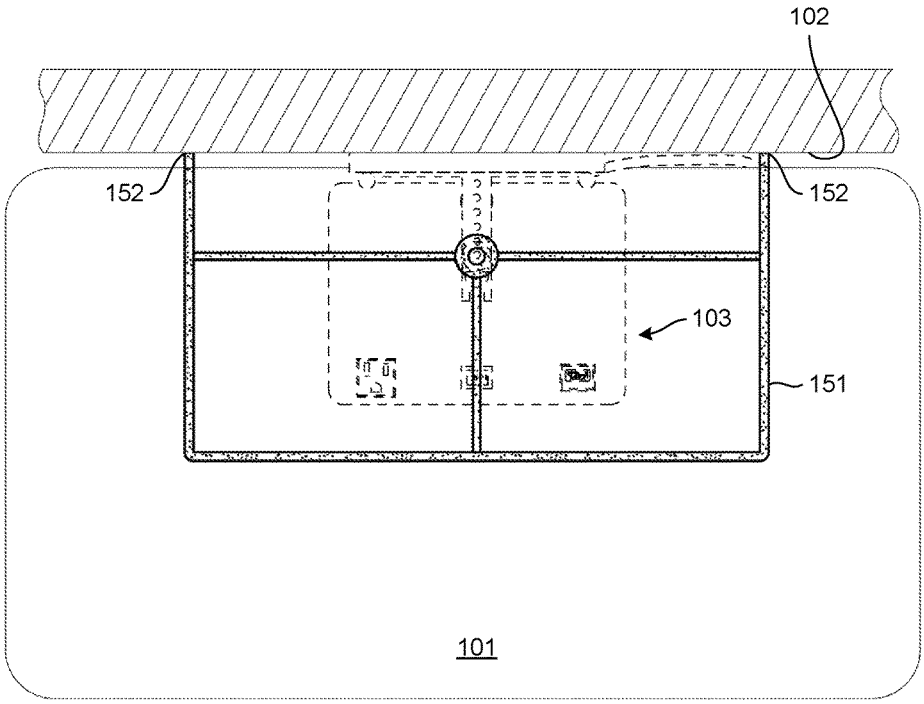
FIG. 19 is a top view of the wall-plate table lamp of FIG. 18 shown on a table and abutting a wall.
Figure 21:
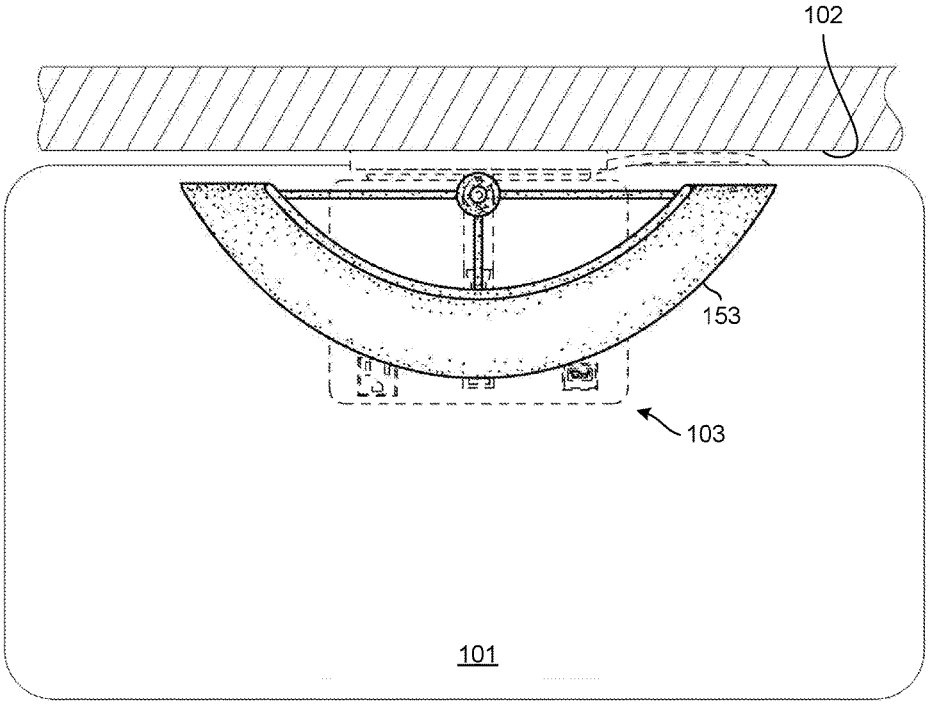
FIG. 21 is a top view of the wall-plate table lamp of FIG. 20 shown on a table and abutting a wall.

Also, as discussed for FIG. 10, the series of holes in the finial adjustment bracket 122 allows each diffuser 126 to be adjusted toward and away from the wall 102. For example, the diffuser 126 may be positioned to be flush with the wall 102 at the edges 152 of the diffuser 126, such as shown in FIG. 19. In other configurations, the diffuser 126 may be positioned slightly away from the wall 102, such as shown in FIG. 21. This adjustability allows the diffuser 126 to conform to the differences in the varied surfaces and textures of different walls. For example, a brick surface with uneven bricks has a different surface and texture as compared to a flat, smooth wall. This adjustability also will help the various diffusers, which have different sizes and configurations, be installed on the various embodiments of the wall-plate table lamp and then be positioned a desired distance from the wall.

Figure 18:
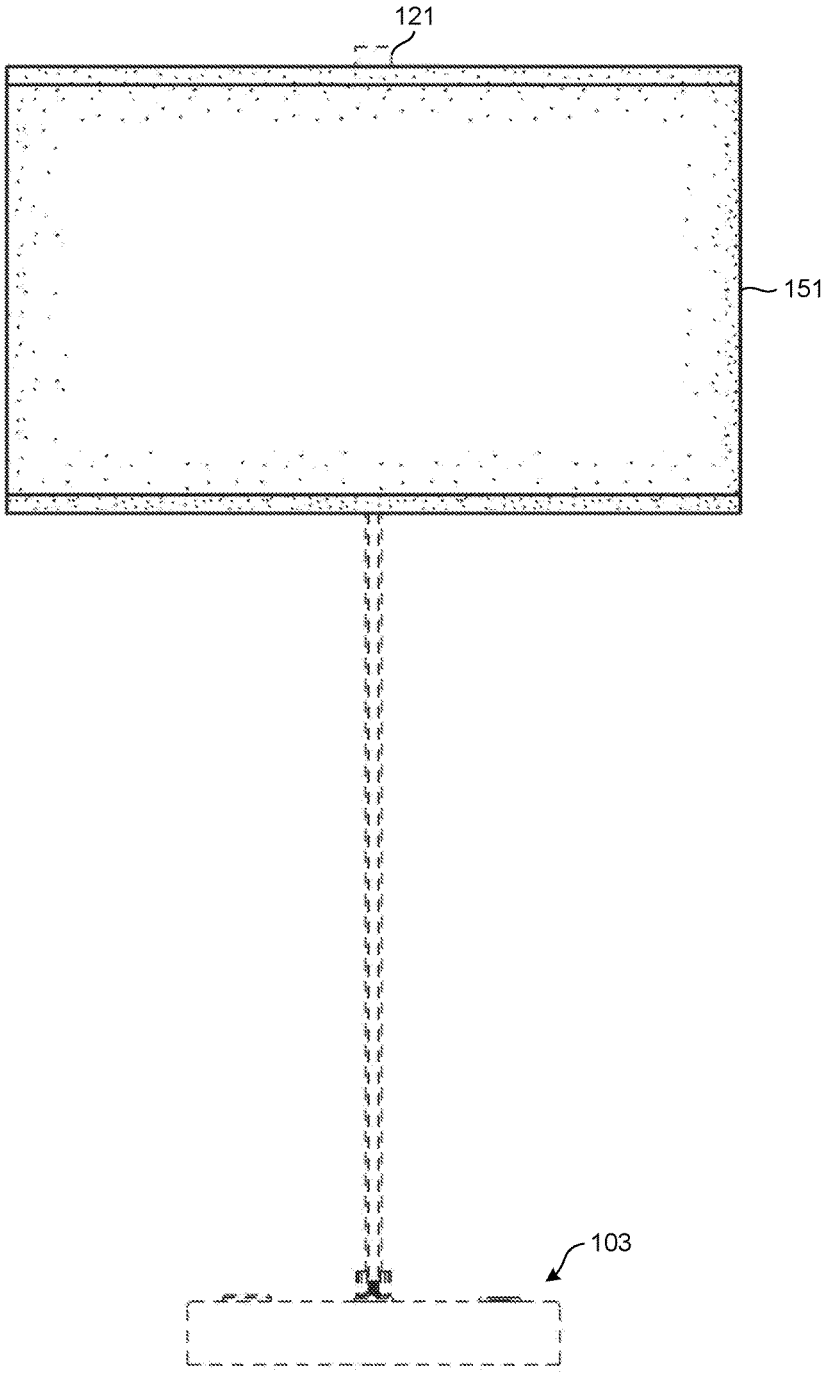
FIG. 18 is a front view of the wall-plate table lamp of FIG. 1, showing a rectangular diffuser.

FIG. 18 is a front view of the wall-plate table lamp 100 of FIG. 1, showing a rectangular diffuser 151. FIG. 19 is a top view of the wall-plate table lamp 100 of FIG. 18 shown on a table 101 and abutting a wall 102.

Figure 20:
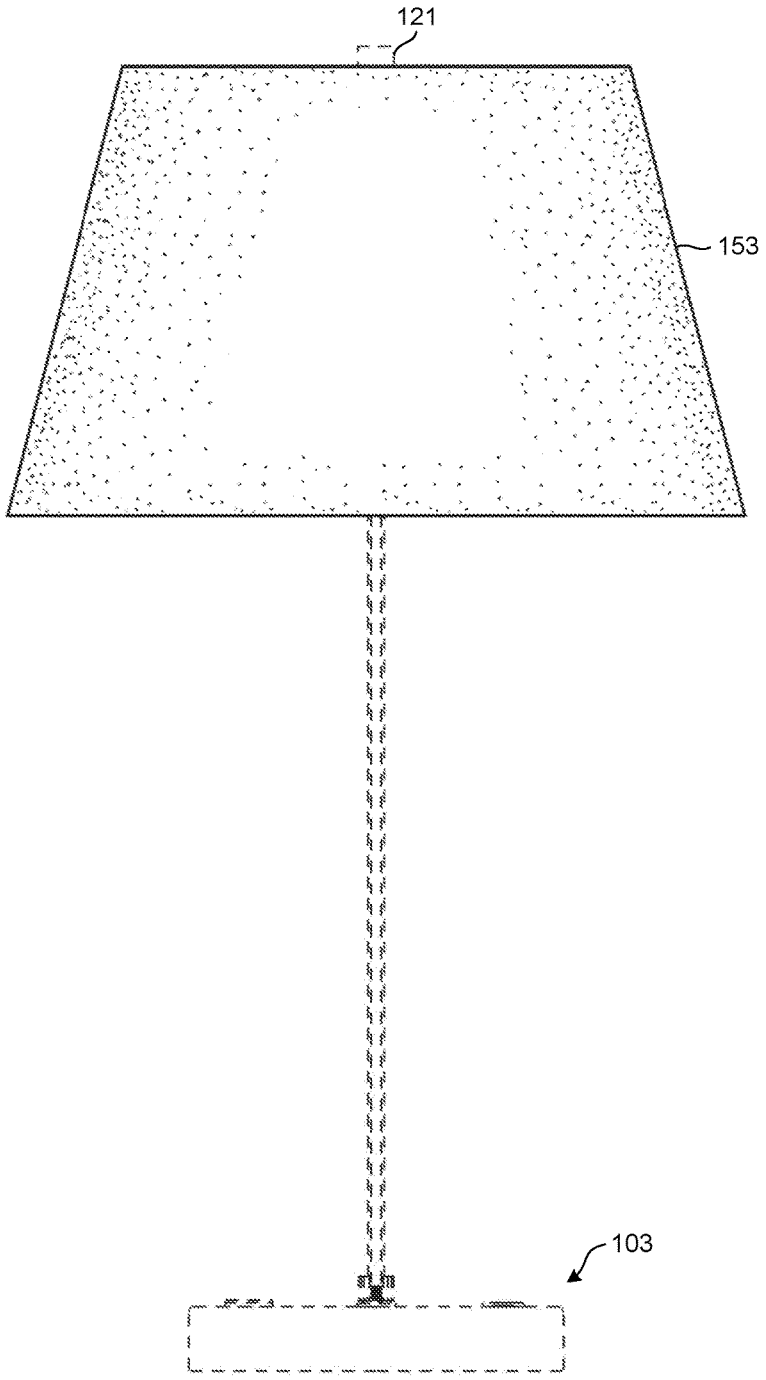
FIG. 20 is a front view of the wall-plate table lamp of FIG. 1, but showing an empire diffuser.

FIG. 20 is a front view of the wall-plate table lamp 100 of FIG. 1, but showing an empire diffuser 153 instead of a rectangular diffuser 151. FIG. 21 is a top view of the wall-plate table lamp 100 of FIG. 20 shown on a table 101 and abutting a wall 102.

Figure 22:
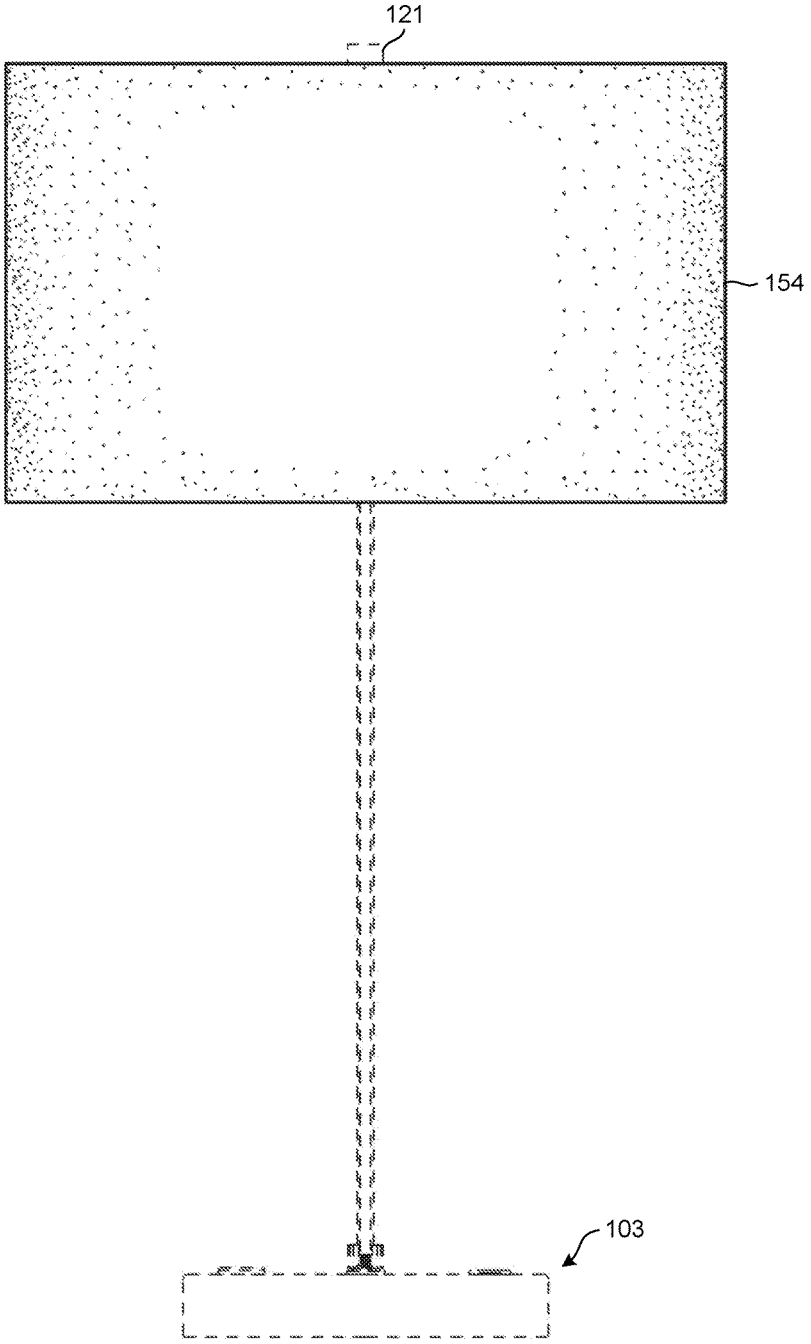
FIG. 22 is a front view of the wall-plate table lamp of FIG. 1, but showing an open-back racetrack diffuser.
Figure 23:
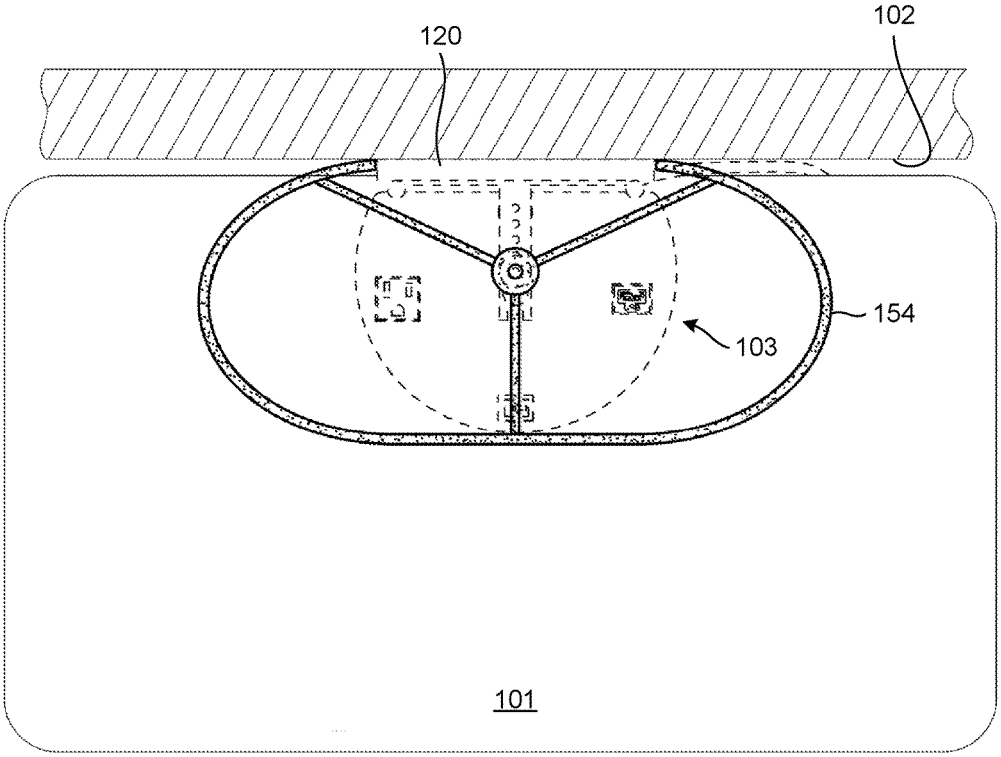
FIG. 23 is a top view of the wall-plate table lamp of FIG. 22 shown on a table and abutting a wall.

FIG. 22 is a front view of the wall-plate table lamp 100 of FIG. 1, but showing an open-back racetrack diffuser 154 instead of a rectangular diffuser 151. FIG. 23 is a top view of the wall-plate table lamp 100 of FIG. 22 shown on a table 101 and abutting a wall 102. As illustrated in FIGS. 22-23, the open-back racetrack diffuser 154 has a cutout in the back that may rest against the sides of the wall plate 120.

Figure 24:
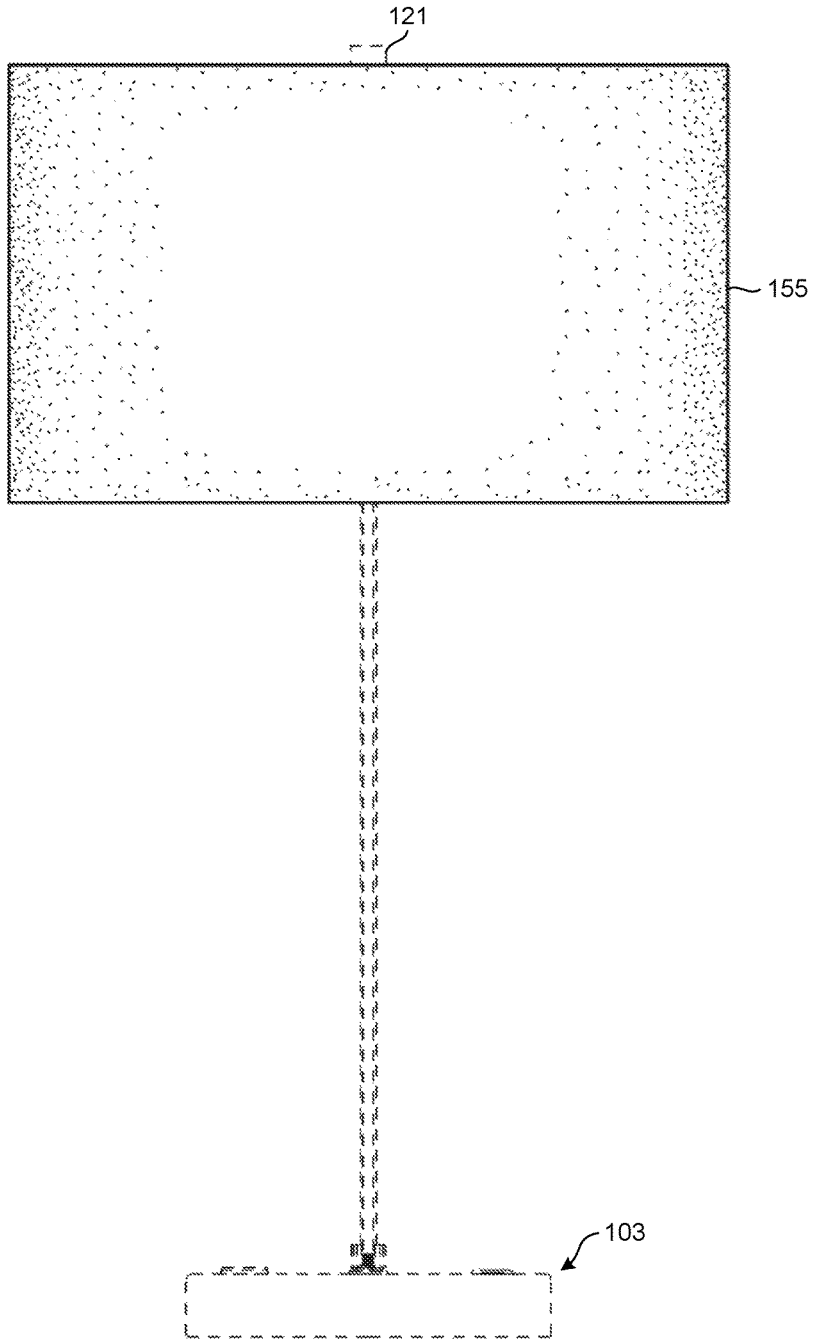
FIG. 24 is a front view of the wall-plate table lamp of FIG. 1, but showing a continuous racetrack diffuser.
Figure 25:
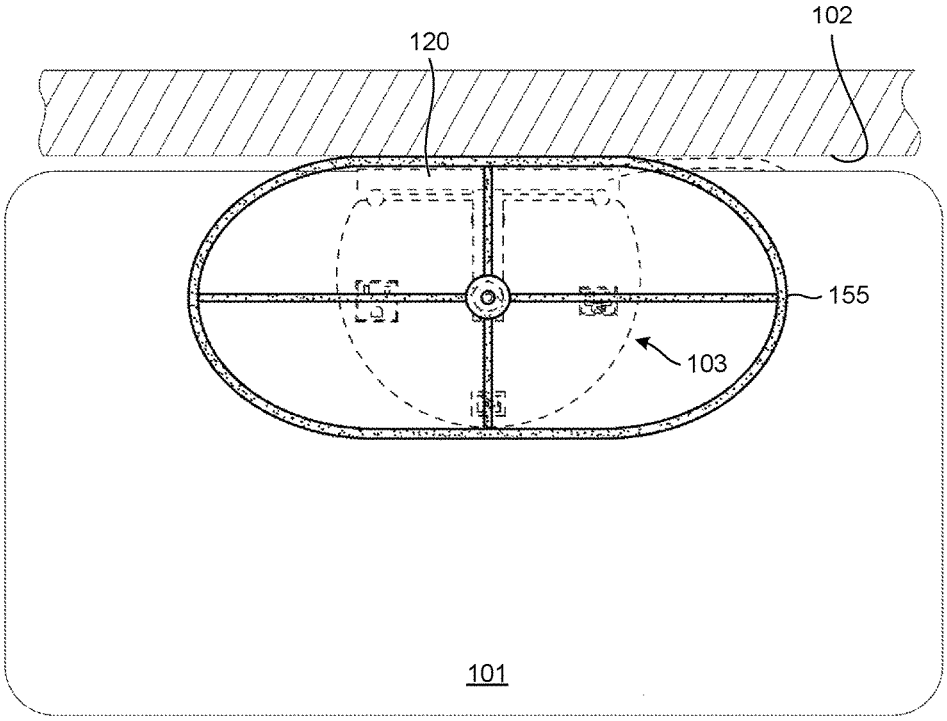
FIG. 25 is a top view of the wall-plate table lamp of FIG. 24 shown on a table and abutting a wall.
Figure 36:
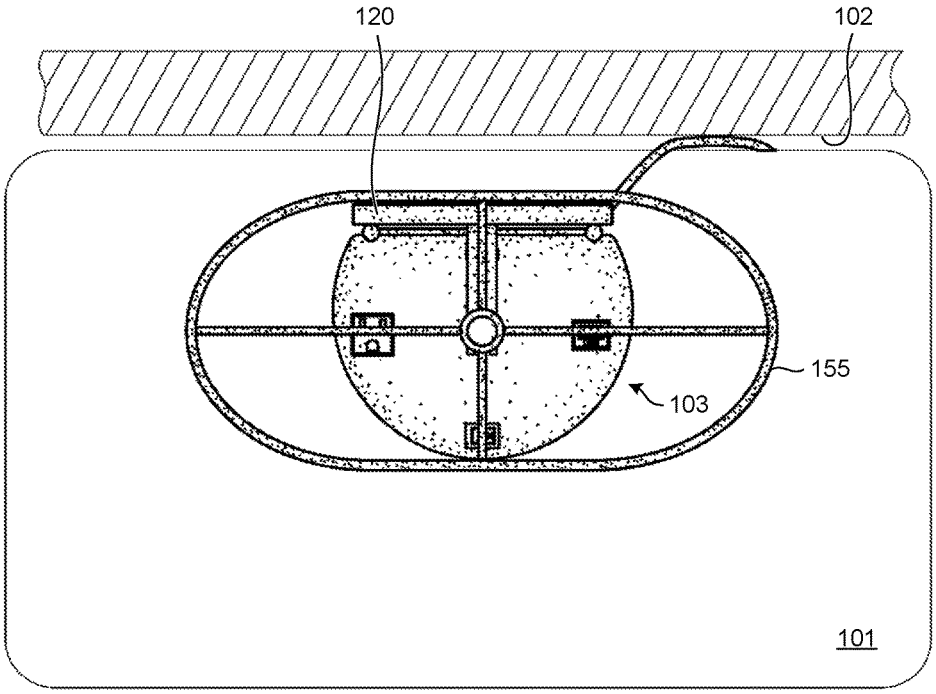
FIG. 36 is a top view of the wall-plate table lamp of FIG. 25 but situated away from the wall.
Figure 37:
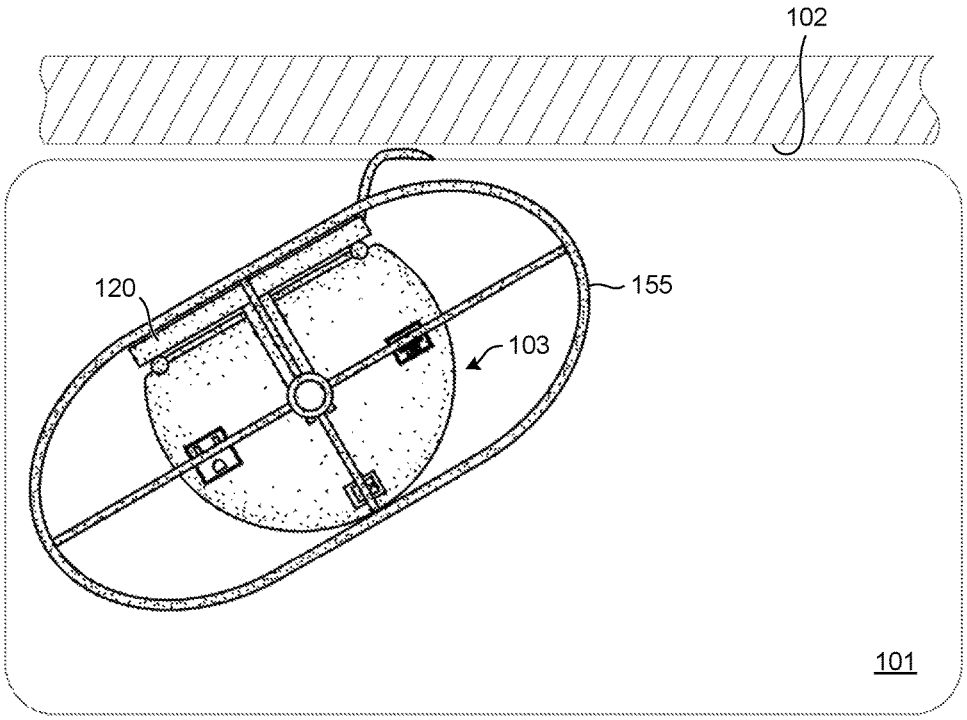
FIG. 37 is a top view of the wall-plate table lamp of FIG. 25 but situated away from the wall.

FIG. 24 is a front view of the wall-plate table lamp 100 of FIG. 1, but showing a continuous racetrack diffuser 155 instead of a rectangular diffuser 151. FIG. 25 is a top view of the wall-plate table lamp 100 of FIG. 24 shown on a table 101 and abutting a wall 102. As illustrated in FIGS. 24-25, the continuous racetrack diffuser 155 follows behind the wall plate 120. By way of example, this configuration may be used with a weight 111 in the table-lamp base 107 to form a self-standing lamp that can be situated toward or away from the wall 102, for example, as illustrated in FIGS. 36 and 37.

Figures 26A, 26B:
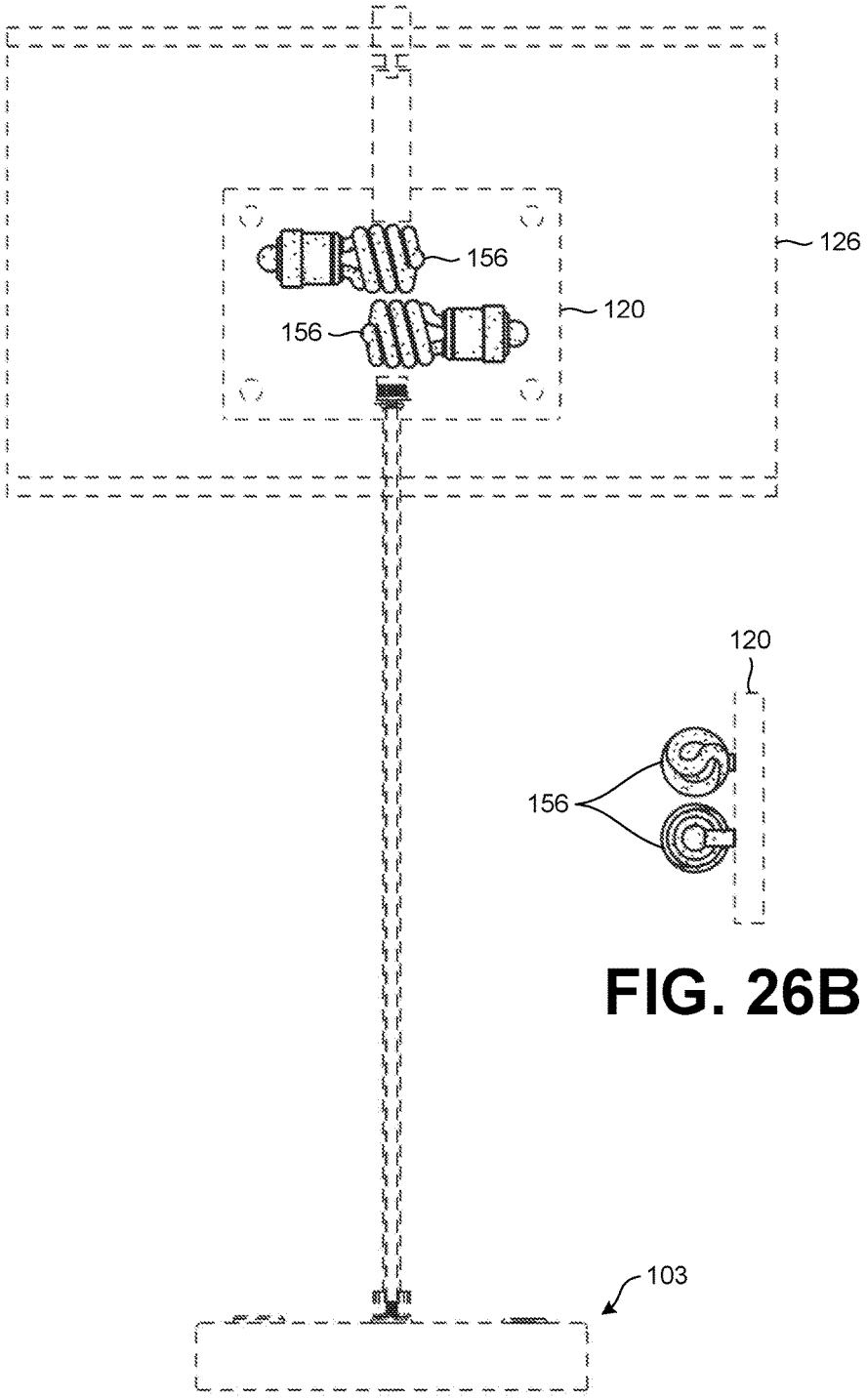
FIG. 26A is a front view of the wall-plate table lamp of FIG. 1, but showing compact fluorescent bulbs as an alternative light source.
FIG. 26B is a side view of the light source portion of FIG. 26A.

FIG. 26A is a front view of the wall-plate table lamp 100 of FIG. 1, but showing compact fluorescent bulbs 156 as an alternative light source. FIG. 26B is a side view of the light source portion of FIG. 26A. While depicted in the figures with a particular configuration, compact fluorescent bulbs 156 may be used with other configurations, too, including the wall-plate table lamp 100 of FIGS. 1-12, the wall-plate table lamp 200 of FIGS. 14A-15, and the wall-plate table lamp 300 of FIGS. 16-17.

Figure 27:
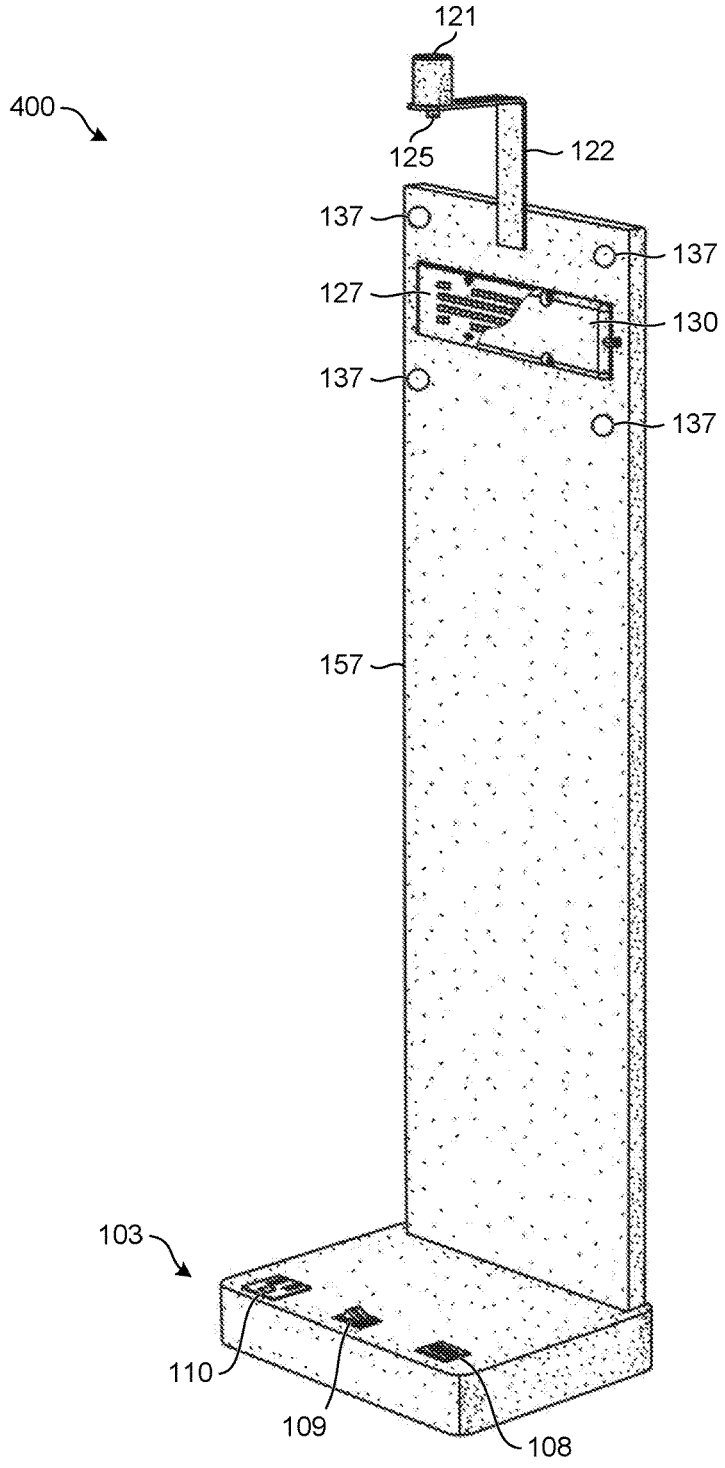
FIG. 27 is a perspective view of a wall-plate table lamp having an extended wall plate.

FIG. 27 is a perspective view of a wall-plate table lamp 400 having an extended wall plate 157. As illustrated in FIG. 27, the wall-plate table lamp 400 is generally as described above for the wall-plate table lamp 100 of FIGS. 1-12, but the wall-plate table lamp 400 may lack the rod 106 and the stem 105 of the wall-plate table lamp 100. Instead, the wall-plate table lamp 400 includes the extended wall plate 157. In this variation, the power supply wire 140 passes through the extended wall plate 157. Alternatively, the power supply wire 140 may pass between the extended wall plate 157 and the wall 102. Thus, the extended wall plate 157 may hide the power supply wire 140 from sight and make the power supply wire 140 generally inaccessible to an operator of the wall-plate table lamp 400.

Figure 28:
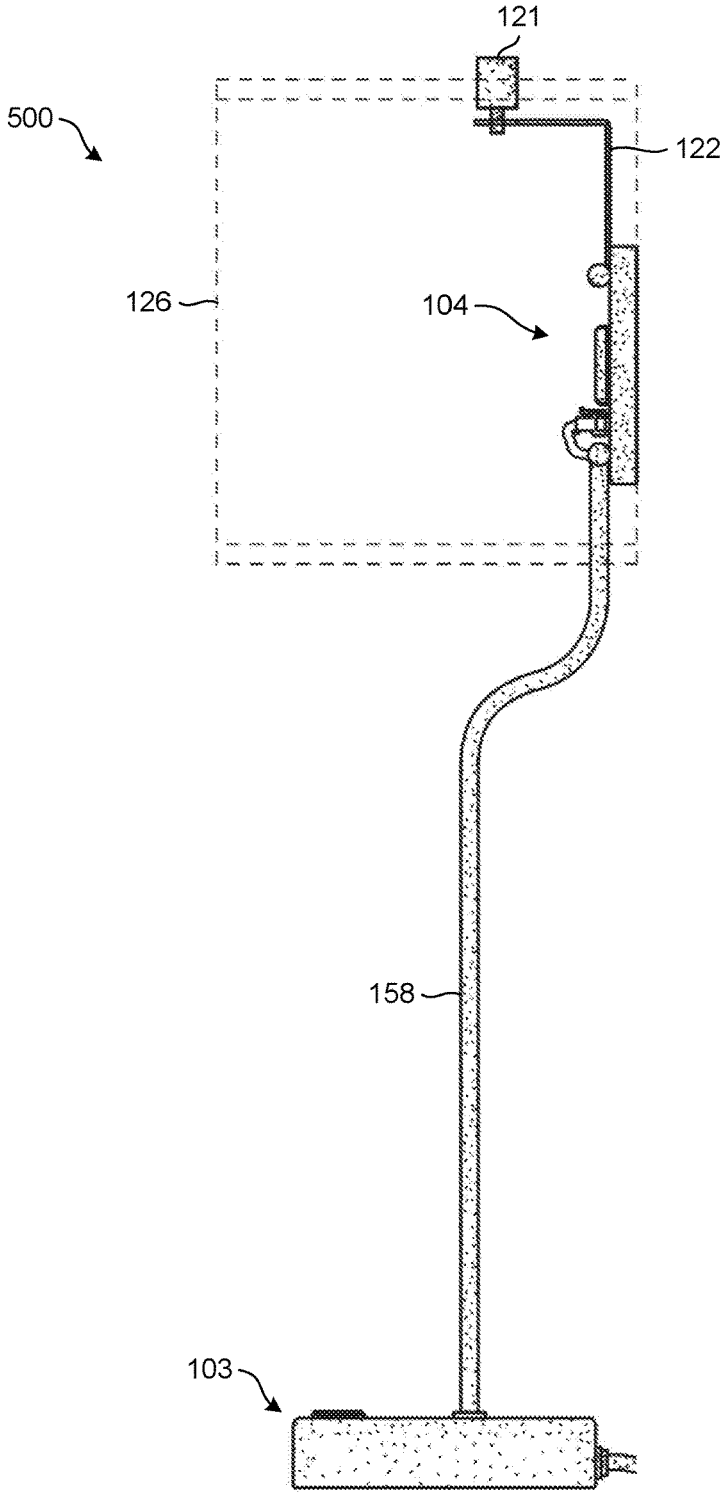
FIG. 28 is a side view of a wall-plate table lamp having a bent stem.

FIG. 28 is a side view of a wall-plate table lamp 500 having a bent stem 158. As illustrated in FIG. 28, the wall-plate table lamp 500 is generally as described above for the wall-plate table lamp 100 of FIGS. 1-12, but the wall-plate table lamp 500 may lack the rod 106, the stem 105, and the rod-and-stem bracket 113 of the wall-plate table lamp 100. Instead, the wall-plate table lamp 500 includes a bent stem 158, which may be affixed directly to the wall plate 120.

The bent stem 158 is generally as described above for the stem 105, but the bent stem 158 includes one or more bends, such as shown in FIG. 28, for example. Other bend configurations are also contemplated.

Figure 29:
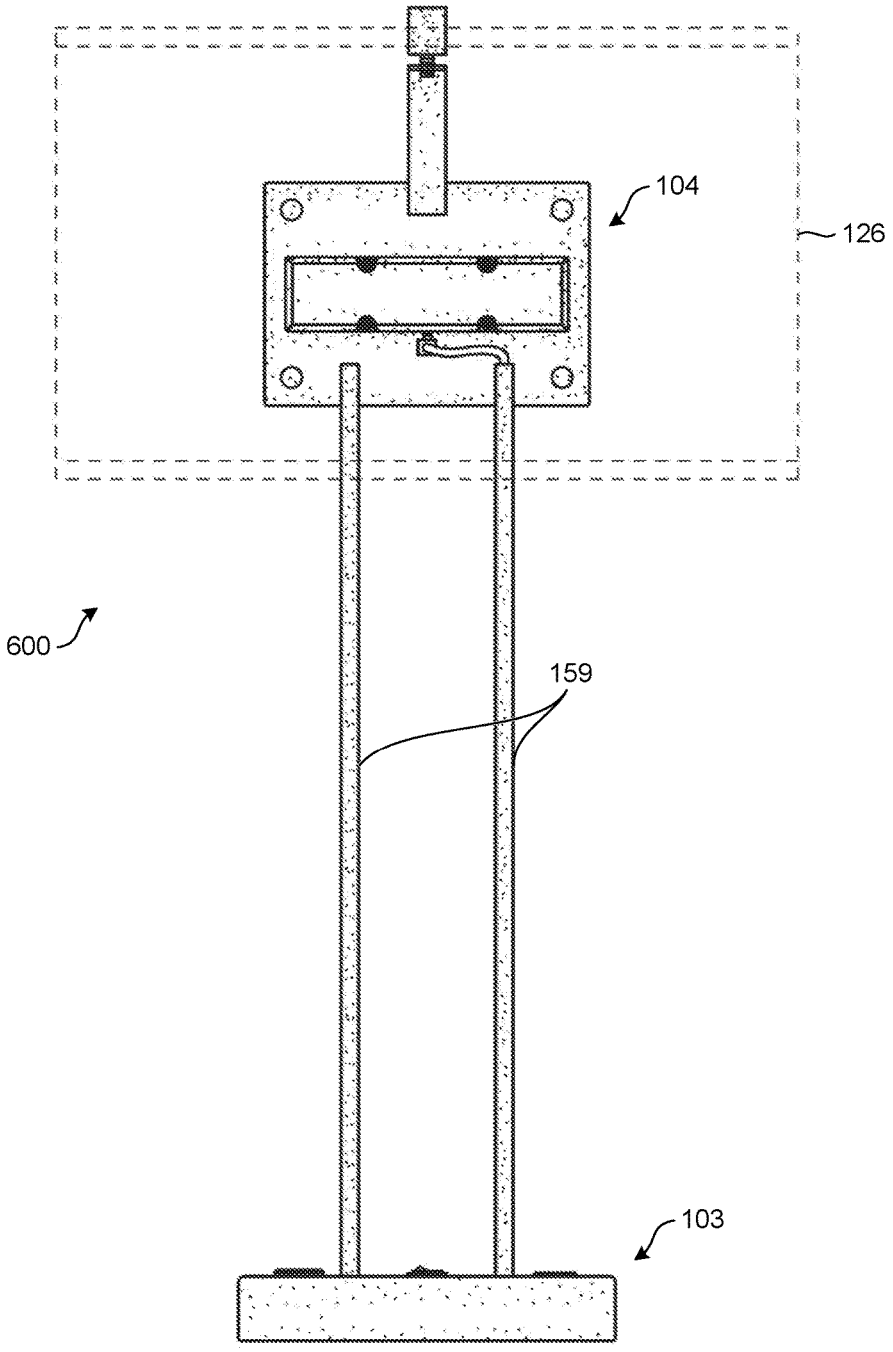
FIG. 29 is a front view of a wall-plate table lamp having a dual stem.

FIG. 29 is a front view of a wall-plate table lamp 600 having a dual stem 159. As illustrated in FIG. 29, the wall-plate table lamp 600 is generally as described above for the wall-plate table lamp 100 of FIGS. 1-12, but the wall-plate table lamp 600 may lack the rod 106, the stem 105, and the rod-and-stem bracket 113 of the wall-plate table lamp 100. Instead, the wall-plate table lamp 600 includes a dual stem 159, which may be affixed directly to the wall plate 120.

The dual stem 159 is generally as described above for the stem 105, but the power supply wire 140 preferably passes through one stem of the dual stem 159. In a variation, the dual stem 159 may instead include three or more stems. In another variation, two or more stems may be combined with the bent stem 158 to form multiple bent stems.

Figure 30:
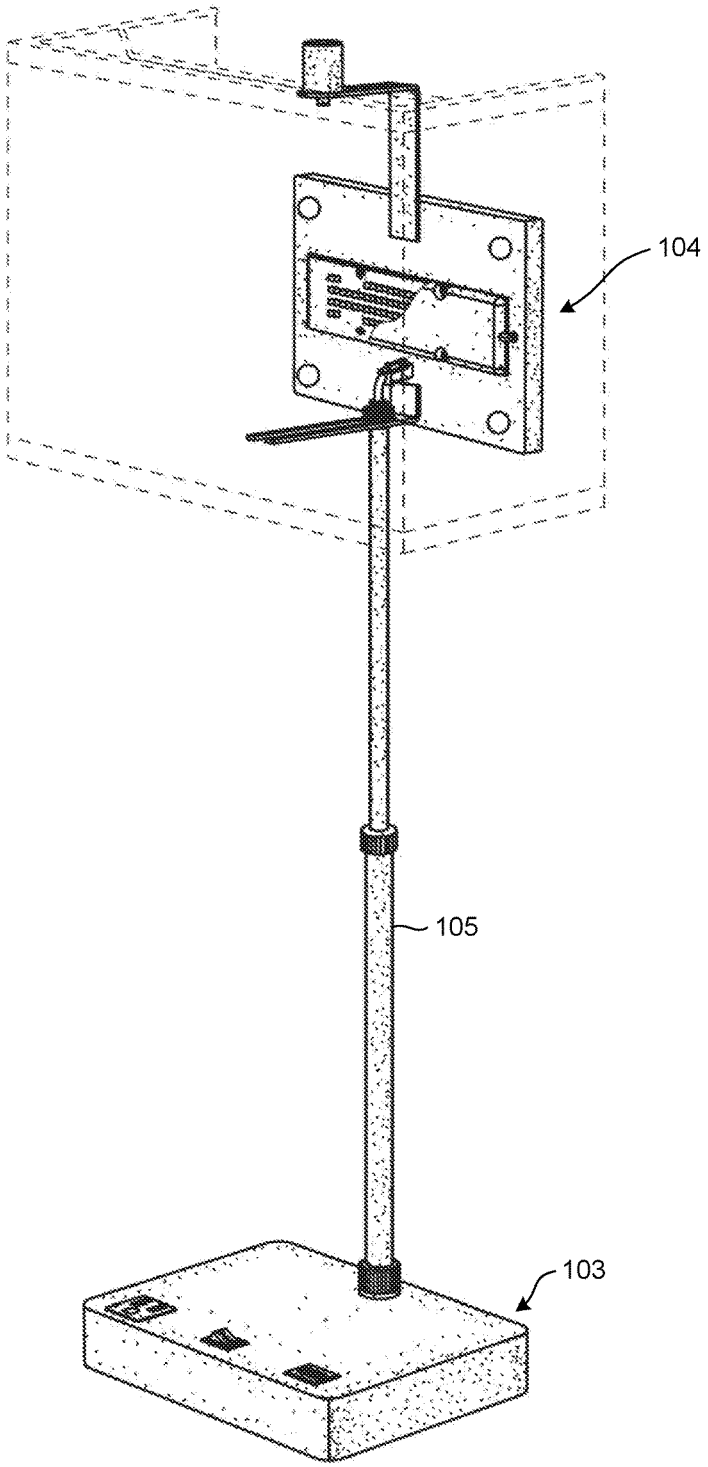
FIG. 30 is a perspective view of a wall-plate table lamp having a telescoping stem.

Other variations of the wall-plate table lamp may include the additional or substitute features. For example, while the table-lamp base 107 is shown as being rectangular or rounded, other shapes are also contemplated. As another example, the stem 105 may have an adjustable length. Accordingly, the stem 105 may be telescoping, such as shown in FIG. 30.

Figure 31:
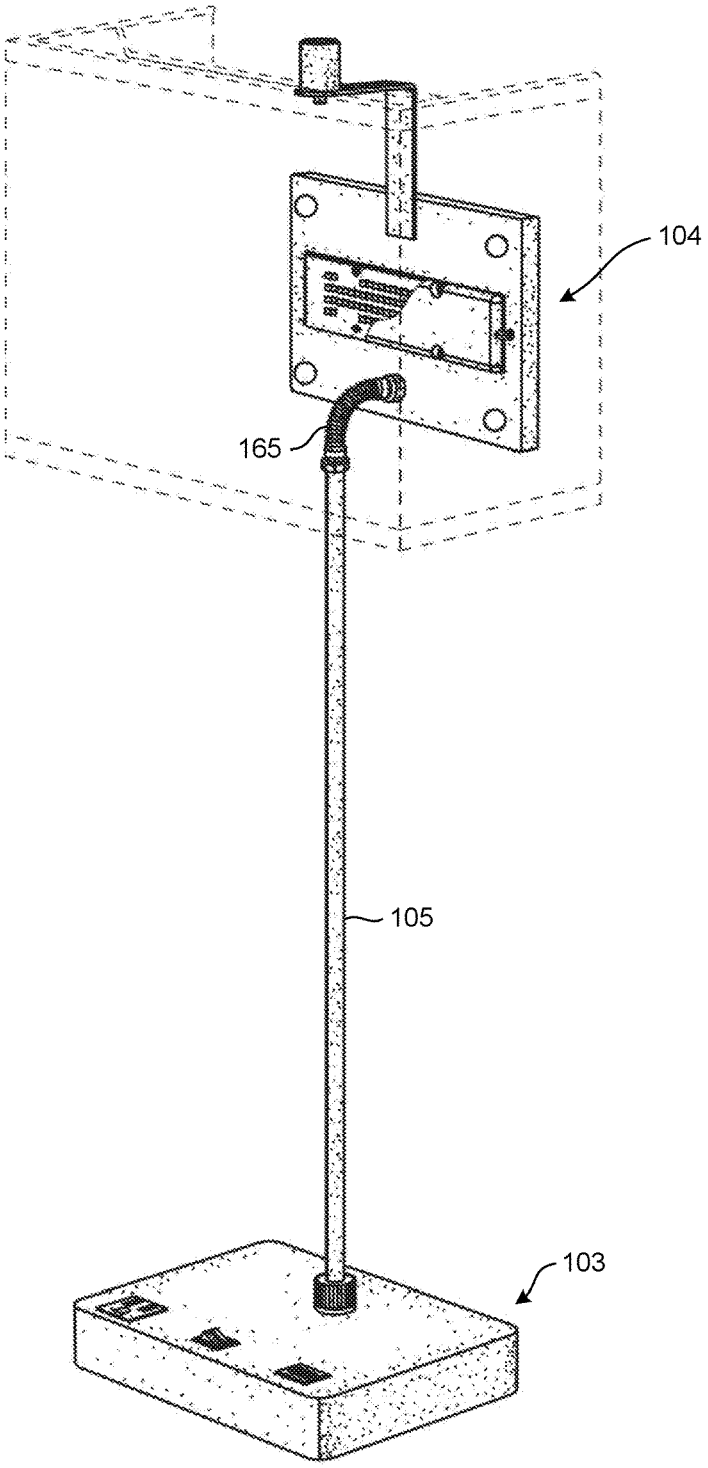
FIG. 31 is a perspective view of a wall-plate table lamp having a stem with a flexible end.

As another example of a variation, the stem 105 may have a flexible end 165, such as shown in FIG. 31, where the flexible end 165 connects directly to the wall plate 120. The flexible end 165 may be, for example, corrugated. The flexible end 165 may be bent at an angle, such as a right angle as shown in FIG. 31, relative to the substantially vertical length of the stem 105.

Figures 32A, 32B:
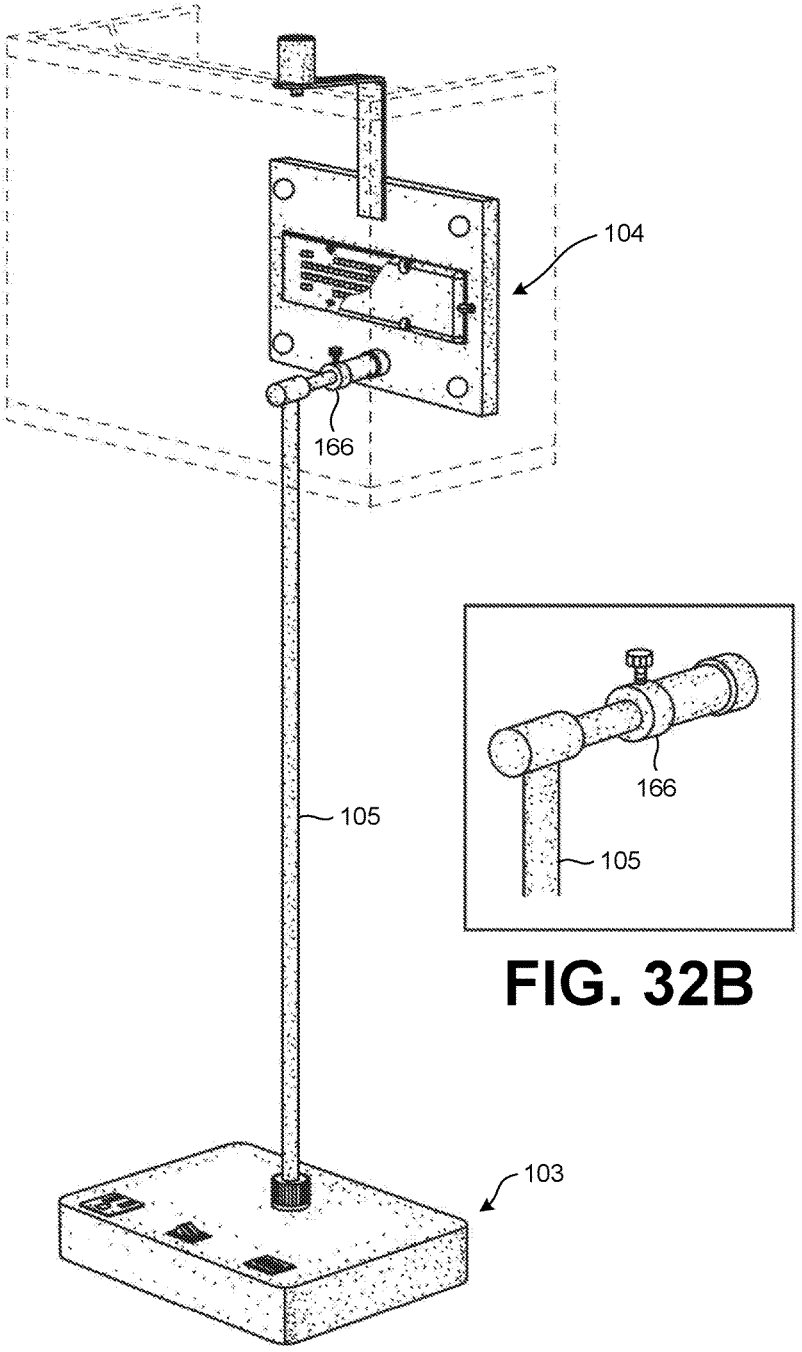
FIG. 32A is a perspective view of a wall-plate table lamp having a stem with a telescoping attachment tube.
FIG. 32B is a detailed illustration of the telescoping attachment tube of FIG. 32A.

As yet another example of a variation, the stem 105 may include a telescoping attachment tube 166, such as shown in FIGS. 32A-32B.

Figure 33:
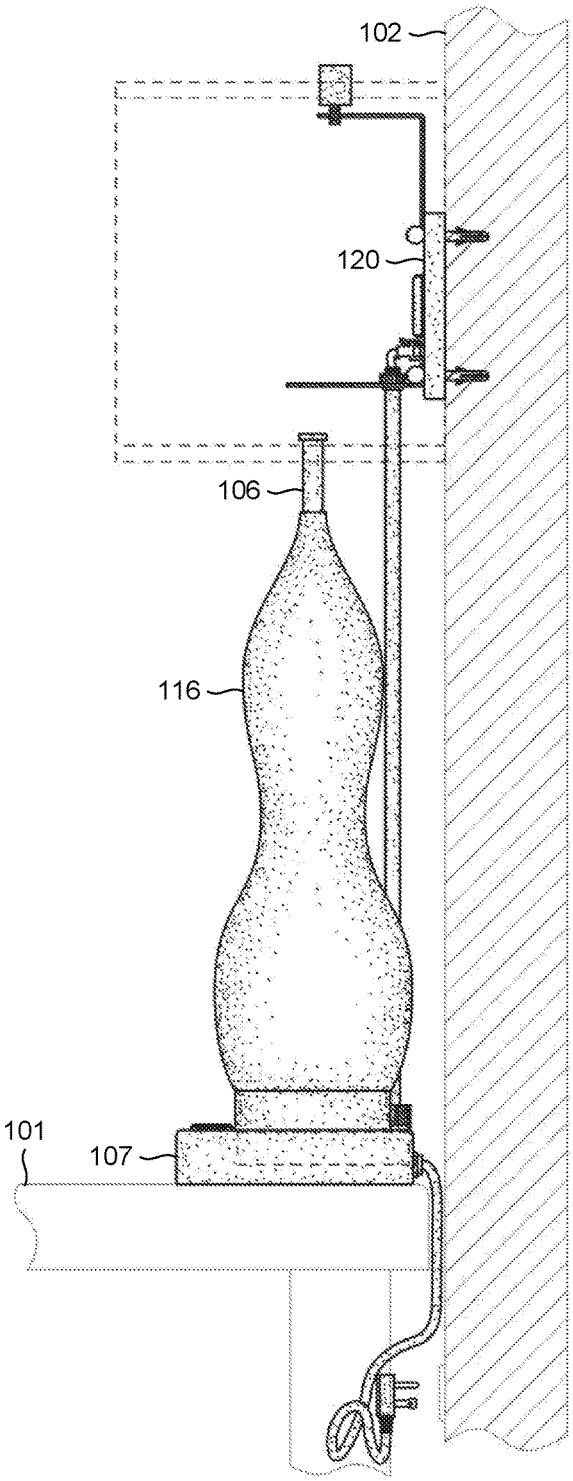
FIG. 33 is a side view of a wall-plate table lamp shown on a table and abutting a wall, in which the top-affixed decorative element does not attach to the rod-and-stem bracket.

As still another example of a variation, the top-affixed decorative element 116, or the rod 106 running through the top-affixed decorative element 116, does not attach to the rod-and-stem bracket 113, such as shown in FIG. 33. Thus, the top-affixed decorative element 116 may extend substantially between the table-lamp base 107 and the rod-and-stem bracket 113 without necessarily contacting the rod-and-stem bracket 113.

Figure 34A:
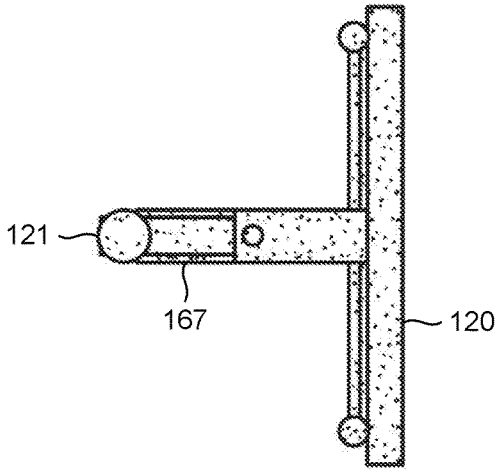
FIG. 34A is a top view of a wall plate assembly, showing a finial adjustment bracket with a flat-bar telescoping section.
Figure 34B:
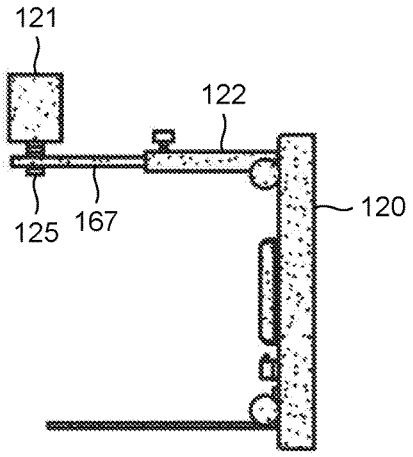
FIG. 34B is a right side view of the wall plate assembly of FIG. 34A.

As another example of a variation, instead of a series of holes that the finial 121 with the threaded post 125 may be threaded into, the finial adjustment bracket 122 may include other adjustment features. For example, as shown in FIGS. 34A-34B, the finial adjustment bracket 122 may include a telescoping section 167, such as the flat-bar telescoping section 167 illustrated. Thus, the finial adjustment bracket 122 may telescope between an extended position, a retracted position, and one or more positions between the extended position and the retracted position. As another example, as shown in FIGS. 35A-34C, the finial adjustment bracket 122 may include an elongated slot 168, and the threaded post 125 may include a machined nut 169 configured to engage the elongated slot 168.

Thus, embodiments of the disclosed wall-plate table lamp provide a space saving, versatile, and sustainable lamp with changeable decorative elements. Even so, while the previously described versions of the disclosed subject matter have one or more of these advantages or features, or other advantages that would be apparent to a person of ordinary skill, all of these advantages or features are not required in all versions of the disclosed wall-plate table lamp.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Furthermore, the term "comprises" and its grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components.

Also, directions such as "vertical," "horizontal," "top," "bottom," "front," and "back" are used for convenience and in reference to the views provided in figures. But the wall-plate table lamp 100 may have a number of orientations in actual use.

Although specific embodiments of the invention have been illustrated and described for purposes of illustration, it will be understood that various modifications may be made without departing from the spirit and scope of the invention. Accordingly, the invention should not be limited except as by the appended claims.

The invention claimed is:

1. A table lamp comprising:

a table-lamp base configured to rest on a horizontal surface;

a wall plate assembly configured to abut a vertical surface above the horizontal surface, the wall plate assembly having a light source;

an electrical cable coupling the table-lamp base to the wall plate assembly, the electrical cable configured to transmit electrical power from the table-lamp base to the wall plate assembly; and wherein the table-lamp base is configured to adjust toward or away from the vertical surface while the wall plate assembly abuts the vertical surface.

2. The table lamp of claim 1, in which the wall plate assembly is further configured to be affixed to the vertical surface.

3. The table lamp of claim 1, the table-lamp base further comprising an electrical switch configured to control the light source at the wall plate assembly from the table-lamp base.

4. The table lamp of claim 1, the table-lamp base further comprising an electrical outlet port.

5. The table lamp of claim 1, the table-lamp base further comprising a universal serial bus (USB) port.

6. The table lamp of claim 1, in which the wall plate assembly further comprises a substantially vertical plate and the table-lamp base comprises a substantially horizontal plate, a face of the substantially vertical plate being configured to abut the vertical surface, a face of the substantially horizontal plate is configured to rest on the horizontal surface.

7. The table lamp of claim 6, in which the face of the substantially vertical plate has an area and the face of the substantially horizontal plate has an area, in which the area of the face of the substantially vertical plate is at least thirty percent of the area of the face of the substantially horizontal plate.

8. A table lamp comprising:

a table-lamp base configured to rest on a horizontal surface;

a wall plate assembly configured to abut a vertical surface above the horizontal surface, the wall plate assembly having a light source;

an electrical cable coupling the table-lamp base to the wall plate assembly, the electrical cable configured to transmit electrical power from the table-lamp base to the wall plate assembly; and a light diffuser coupled to the wall plate assembly, the light diffuser being configured to diffuse light emitted from the light source and to adjust toward or away from the vertical surface while the wall plate assembly abuts the vertical surface.

9. A table lamp comprising:

a table-lamp base configured to rest on a horizontal surface;

a wall plate assembly configured to abut a vertical surface above the horizontal surface, the wall plate assembly having a light source;

an electrical cable coupling the table-lamp base to the wall plate assembly, the electrical cable configured to transmit electrical power from the table-lamp base to the wall plate assembly; and a stem having an adjustable length extending between the table-lamp base and the wall plate assembly, the stem being coupled to the table-lamp base at a first end of the stem and being coupled to the wall plate assembly at an opposite, second end of the stem, the stem substantially enclosing the electrical cable between the table-lamp base and the wall plate assembly.

10. The table lamp of claim 9, in which the stem is a single, straight shaft.

11. The table lamp of claim 9, in which the stem includes two or more bends.

12. The table lamp of claim 9, in which the second end of the stem is flexible and is bent at an angle less than 180° to a length of the stem.

13. A table lamp comprising:

a table-lamp base configured to rest on a horizontal surface;

a wall plate assembly configured to abut a vertical surface above the horizontal surface, the wall plate assembly having a light source; and an electrical cable coupling the table-lamp base to the wall plate assembly, the electrical cable configured to transmit electrical power from the table-lamp base to the wall plate assembly; and a stem extending between the table-lamp base and the wall plate assembly, the stem being coupled to the table-lamp base at a first end of the stem and being coupled to the wall plate assembly at an opposite, second end of the stem, the stem substantially enclosing the electrical cable between the table-lamp base and the wall plate assembly, and the second end of the stem including an attachment tube between the stem and the wall plate assembly, the attachment tube being configured to telescope between the stem and the wall plate assembly.

14. A table lamp comprising:

a table-lamp base configured to rest on a horizontal surface;

a wall plate assembly configured to abut a vertical surface above the horizontal surface;

a bracket affixed to a vertical side of the wall plate;

an electrical cable coupling the table-lamp base to the wall plate assembly, the electrical cable configured to transmit electrical power from the table-lamp base to the wall plate assembly; and a stem extending between the table-lamp base and the bracket, the stem being affixed to the table-lamp base at a first end of the stem and being affixed to the bracket at an opposite, second end of the stem, the stem substantially enclosing the electrical cable between the table-lamp base and the bracket.

15. A table lamp comprising:

a table-lamp base configured to rest on a horizontal surface;

a wall plate assembly configured to abut a vertical surface above the horizontal surface, the wall plate assembly having a light source;

an electrical cable coupling the table-lamp base to the wall plate assembly, the electrical cable configured to transmit electrical power from the table-lamp base to the wall plate assembly;

a bracket affixed to the substantially vertical wall plate; and a stem extending between the table-lamp base and the bracket, the stem being affixed to the table-lamp base at a first end of the stem and being affixed to the bracket at an opposite, second end of the stem, the stem substantially enclosing the electrical cable between the table-lamp base and the bracket, the bracket further comprising an elongated slot extending longitudinally away from the wall plate assembly, in which the stem is slidingly adjustable within the elongated slot while remaining affixed to the table-lamp base.

16. A table lamp comprising:

a table-lamp base configured to rest on a surface;

a light assembly containing a light source;

an electrical cable coupling the table-lamp base to the light source, the electrical cable configured to transmit electrical power from the table-lamp base to the light source;

a bracket affixed to the light assembly containing the light source; and a replaceable decorative element extending substantially between the table-lamp base and the bracket; and a rod extending through the decorative element and between the bracket and the table-lamp base, the rod being removably affixed to the table-lamp base at a first end of the rod and being removably affixed to the bracket at an opposite, second end of the rod.

17. The table lamp of claim 16, further comprising a stem extending between the table-lamp base and the bracket, the stem being affixed to the table-lamp base at a first end of the stem and being affixed to the bracket at an opposite, second end of the stem, the stem substantially enclosing the electrical cable between the table-lamp base and the bracket, in which the replaceable decorative element is mounted to the table-lamp base and at least partially surrounds the stem.

18. The table lamp of claim 16, further comprising a stem extending between the table-lamp base and the bracket, the stem being affixed to the table-lamp base at a first end of the stem and being affixed to the bracket at an opposite, second end of the stem, the stem substantially enclosing the electrical cable between the table-lamp base and the bracket.

19. The table lamp of claim 18, the bracket further comprising an elongated slot extending longitudinally away from the wall plate assembly, in which the rod and the stem are each slidingly adjustable within the elongated slot while remaining affixed to the table-lamp base.

20. A table lamp comprising:

a table-lamp base configured to rest on a horizontal surface;

a wall plate assembly configured to abut a vertical surface above the horizontal surface, the wall plate assembly having a light source;

an electrical cable coupling the table-lamp base to the wall plate assembly, the electrical cable configured to transmit electrical power from the table-lamp base to the wall plate assembly;

a finial bracket affixed to the wall plate assembly and extending away from a substantially vertical plate;

a finial secured to the finial bracket; and a light diffuser clamped to the finial bracket by the finial.

21. The table lamp of claim 20, in which the finial bracket is configured to secure the finial to any one of a plurality of positions within the finial bracket.

22. The table lamp of claim 21, in which the plurality of positions includes a series of holes extending away from the substantially vertical plate, in which each hole in the series of holes is configured to accept the finial, a position of the light diffuser relative to the vertical surface being adjustable by securing the finial in a hole in the series of holes.

23. The table lamp of claim 21, in which the finial bracket is configured to telescope between an extended position, a retracted position, and at least one position between the extended position and the retracted position.

24. The table lamp of claim 21, in which the finial bracket includes an elongated slot extending away from the substantially vertical plate; and a nut configured to slide in the elongated slot, the finial being secured to the finial bracket through the nut.

25. A table lamp comprising:

a table-lamp base configured to rest on a horizontal surface;

a wall plate assembly configured to abut a vertical surface above the horizontal surface, in which the wall plate assembly has a light source and abuts the table-lamp base; and an electrical cable coupling the table-lamp base to the wall plate assembly, the electrical cable configured to transmit electrical power from the table-lamp base to the wall plate assembly.

26. A self-standing table lamp comprising:

a table-lamp base configured to rest on a horizontal surface;

a wall plate assembly with a light source, the wall plate configured to abut a vertical surface above the horizontal surface;

an electrical cable coupling the table-lamp base to the wall plate assembly, the electrical cable configured to transmit electrical power from the table-lamp base to the wall plate assembly;

a first connector electrically connected to the light source and mounted on the wall plate assembly; and a second connector electrically connected to an end of the electrical cable and removably affixed to the first connector.

27. The self-standing table lamp of claim 26, wherein the second connector is pluggably attachable and detachable to the first connector.

28. The self-standing table lamp of claim 26, further comprising a light diffuser coupled to the wall plate assembly and configured to diffuse light emitted from the light source.

29. The self-standing table lamp of claim 26, the table-lamp base further comprising an electrical switch configured to control the light source at the wall plate assembly from the table-lamp base.

30. The self-standing table lamp of claim 26, further comprising a stem extending between the table-lamp base and the wall plate assembly, the stem being coupled to the table-lamp base at a first end of the stem and being coupled to the wall plate assembly at an opposite, second end of the stem, the stem substantially enclosing the electrical cable between the table-lamp base and the wall plate assembly.

31. The self-standing table lamp of claim 26, in which the wall plate assembly further comprises:

a bracket affixed to a substantially vertical plate of the wall plate assembly, the table lamp further comprising a stem extending between the table-lamp base and the bracket, the stem being affixed to the table-lamp base at a first end of the stem and being affixed to the bracket at an opposite, second end of the stem, the stem substantially enclosing the electrical cable between the table-lamp base and the bracket.

32. The self-standing table lamp of claim 26, further comprising:

a bracket affixed to the wall plate assembly; and a replaceable decorative element extending substantially between the table-lamp base and the bracket.

33. A lamp comprising:

a base configured to rest on a surface;

a light assembly to retain a light source, wherein the light assembly includes a wall plate configured to abut a vertical surface and the base is configured to adjust toward or away from the vertical surface while the wall plate abuts the vertical surface;

a structural support extending between the base and the light assembly, the structural support coupled at a first end to the base and coupled at an second opposite end to the light assembly; and a replaceable decorative element extending between the base and the light assembly.

34. The lamp of claim 33, further comprising an electrical cable coupling the base to the light assembly, the electrical cable configured to transmit electrical power from the base to the light source.

35. The lamp of claim 34, wherein the structural support substantially encloses the electrical cable between the base and the light assembly.

36. The lamp of claim 33, further comprising a light diffuser coupled to the light assembly, the light diffuser configured to diffuse light emitted from the light source and the replaceable decorative element extends from the base at least up to a bottom end of the light diffuser.

37. The lamp of claim 33, wherein the structural support has an adjustable length.

38. The lamp of claim 33, wherein the structural support comprises a flat plate.

39. The lamp of claim 33, wherein the structural support comprises a round rod.

40. The lamp of claim 33, wherein the replaceable decorative element extends at least partially around the structural support.

* * * * *